US010290392B2

(12) United States Patent
Green et al.

(10) Patent No.: US 10,290,392 B2
(45) Date of Patent: May 14, 2019

(54) ELECTRIC CABLES HAVING SELF-PROTECTIVE PROPERTIES AND IMMUNITY TO MAGNETIC INTERFERENCES

(71) Applicant: Green ELMF Cables Ltd., Haifa (IL)

(72) Inventors: Shalom Green, Haifa (IL); Ran Sagiv, Haifa (IL); Ehud Admati, Haifa (IL); Yosef Grach, Haifa (IL)

(73) Assignee: GREEN ELMF CABLES LTD., Haifa (IL)

( * ) Notice: Subject to any disclaimer, the term of this patent is extended or adjusted under 35 U.S.C. 154(b) by 0 days.

(21) Appl. No.: 14/589,258

(22) Filed: Jan. 5, 2015

(65) Prior Publication Data

US 2015/0107874 A1 Apr. 23, 2015

Related U.S. Application Data

(63) Continuation-in-part of application No. PCT/IL2013/050570, filed on Jul. 4, 2013.

(30) Foreign Application Priority Data

Jul. 5, 2012 (IL) ..... 220781
Jan. 15, 2013 (IL) ..... 224239

(51) Int. Cl.
*H01B 7/00* (2006.01)
*H01B 9/00* (2006.01)
(Continued)

(52) U.S. Cl.
CPC ..... *H01B 7/0009* (2013.01); *H01B 9/006* (2013.01); *H01B 13/0036* (2013.01); *H01B 7/30* (2013.01);
(Continued)

(58) Field of Classification Search
CPC ..... H01B 7/30
(Continued)

(56) References Cited

U.S. PATENT DOCUMENTS 3,675,042 A * 7/1972 Merriam ..... H01B 12/02 174/113 R
5,444,184 A * 8/1995 Hassel ..... H01B 9/003 174/113 C
(Continued)

FOREIGN PATENT DOCUMENTS

DE 1802444 A1 6/1970
EP 2031604 A2 3/2009
(Continued)

OTHER PUBLICATIONS

Supplementary Partial European Search Report for EP13813024 dated May 31, 2016.

*Primary Examiner* — Stanley Tso
(74) *Attorney, Agent, or Firm* — Browdy and Neimark, P.L.L.C.

(57) ABSTRACT

The present invention provides electric cable having substantial immunity to external magnetic fields. The cables may be prepared by splitting one or more conductors of an original cable design into two or more sub-conductors, determining a crosssectional area for each one of the sub-conductors to obtain a desirable electrical current density therethrough, arranging the sub-conductors in said cable in an intervening fashion such that each sub-conductor is placed adjacent and alongside at least one neighboring conductor or sub-conductor associated with either a different electrical phase or electric current direction, and electrically connecting the sub-conductors of each split conductor in parallel.

25 Claims, 12 Drawing Sheets

(51) Int. Cl.
*H01B 13/00* (2006.01)
*H01B 7/30* (2006.01)

(52) U.S. Cl.
CPC .... *Y10T 29/49004* (2015.01); *Y10T 29/49194* (2015.01)

(58) Field of Classification Search
USPC ..... 174/114 R
See application file for complete search history.

(56) References Cited

U.S. PATENT DOCUMENTS

| | | | | |
|---|---|---|---|---|
| 6,365,836 | B1 | 4/2002 | Blouin et al. | |
| 6,506,971 | B1 * | 1/2003 | Grach | H01B 7/30 174/32 |
| 8,071,880 | B2 | 12/2011 | Groegl et al. | |
| 2005/0167150 | A1 * | 8/2005 | Studer | H01B 9/04 174/113 R |
| 2008/0105449 | A1 * | 5/2008 | Kenny | H01B 7/0233 174/34 |
| 2008/0293575 | A1 * | 11/2008 | Hirose | H01B 12/16 505/230 |
| 2009/0246520 | A1 * | 10/2009 | Park | H01B 3/445 428/365 |
| 2009/0250238 | A1 * | 10/2009 | Picard | H01B 9/028 174/102 R |

FOREIGN PATENT DOCUMENTS

| | | | |
|---|---|---|---|
| FR | 1035809 | A | 8/1953 |
| GB | 1242494 | A | 8/1971 |
| GB | 2059670 | A | 4/1981 |
| JP | S6012210 | A | 1/1985 |
| JP | 09180550 | | 7/1997 |
| JP | 2005044765 | A | 2/2005 |
| WO | 9730460 | A1 | 8/1997 |
| WO | 0000989 | A1 | 1/2000 |
| WO | 2010144543 | A2 | 12/2010 |

* cited by examiner

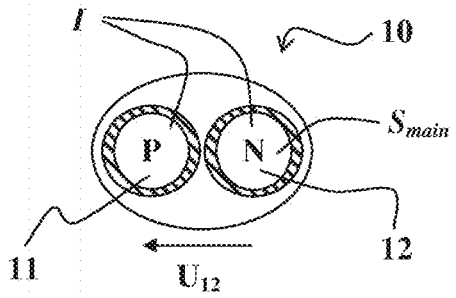
Fig. 1
(prior art)
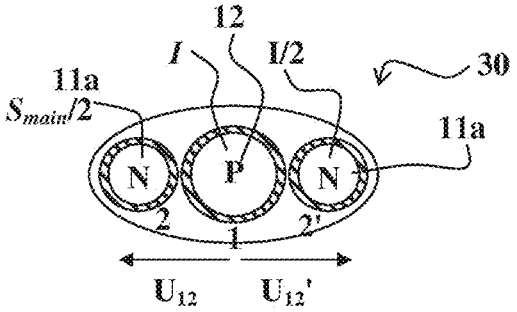
Fig. 2 Single-phase cable type A
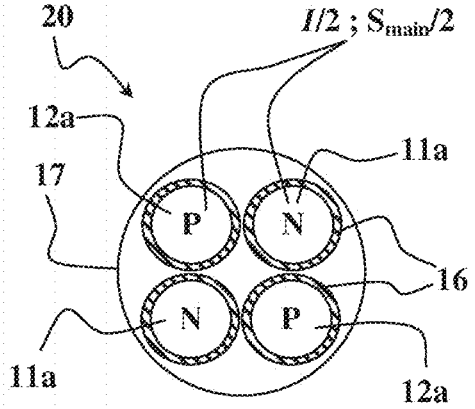
Fig. 3A
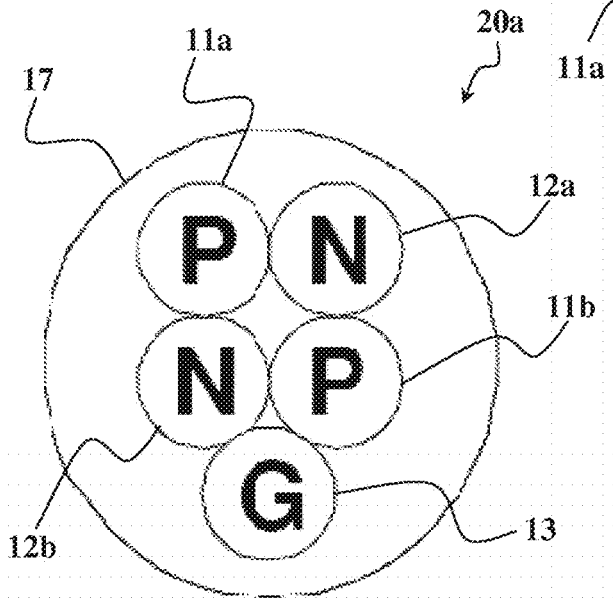
Fig. 3B Three-phase cable type E

ELECTRIC CABLES HAVING SELF-PROTECTIVE PROPERTIES AND IMMUNITY TO MAGNETIC INTERFERENCES

TECHNOLOGICAL FIELD

The present disclosure relates to electric cables having self-protective properties and substantial immunity to external magnetic fields disturbances. More particularly, the present invention provides self-protective electric cables having low sensitivity to external magnetic fields, and methods of designing such cables.

BACKGROUND

The protection of electric and electronic devices against interfering radiation and electric/magnetic fields requires serious attention, in order to prevent system failure and/or unsafe operating conditions. Typically metal shielding is used, in the protection of units which include cables and wires, to block interferences induced due to external fields, and to protect electric devices from interferences that may be induced by adjacently located electric cables.

Metal shielding attenuates the electromagnetic waves energy and thereby reduces energy absorption by the electrically conducting media, and emission of electromagnetic waves energy at the interface between the conductors and shielding medias. It is desirable that the shielding material provide maximal protection and attenuation of electromagnetic field noises/interferences. However, in practice, typical configurations of cable shielding employed nowadays suffer from various disadvantages, such as significant increase of the cables price and of their installation costs.

Conventional shielded cables arrangements are typically vulnerable to magnetic and electrostatic fields generated due to occurrence of lightning discharge and due to the increase of the Earth potential in the grounding area at the location of lighting hit. These phenomena may occur across industrial networks and power circuits and induce voltages that are dangerous for the electrical/electronic equipment electrically fed from the networks/circuitries.

Aerial power transmission lines, contact wires of AC (alternating current) operated trains, radio stations etc., create magnetic fields which induce voltages and currents in cables installed adjacent to them. Under certain conditions the levels of these induced voltages and currents endanger the cable insulation and the devices to which the cable is connected.

Conventional power cables and wires are designed to attenuate the surface effect influence (i.e., to minimize skin effects losses) by using cables' cores formed as a bundle of thin conductors, which are twisted in order to reduce the magnetic field outside the cable (i.e., the field generated by the cable) and obtain reduction coefficient factors in a range of 20 to 30 at a distance of 0.2 m from the center of the power cable. However, twisting the conductors also yields an increase in the in the length of the cable conductors, and consequently increases the active resistance of the conductors. Moreover, the twisting of the conductors may also be inefficient in preventing the losses caused by the surface effect.

Various designs and properties of single and three-phase cables are described in U.S. Pat. No. 6,506,971. This patent describes method of designing a single- or a multi-phase electric cable for conducting current through insulated conductors and creating a weak external magnetic field, so as to obtain a cable wherein at least one of the above-mentioned conductors is assembled from two or more insulated sub-conductors connected in parallel, and wherein the sum of cross-sectional areas of the sub-conductors is equal to a design cross-sectional area of the conductor. The arrangement arrangements in the cable is such that each of the sub-conductors is adjacent to a conductor, or a sub-conductor, associated with either a different phase or a different current direction.

GENERAL DESCRIPTION

There is a need in the art for electric cables having substantial immunity to external magnetic interferences. Conventional cable shielding techniques typically requires arranging the conductors of the cable inside a tubular electrically conducting shield (e.g., made of Copper or Aluminum) acting as a Faraday cage to reduce external interferences. These designs may further require adding an electrically insulating layer between the conductors of the cable and the tubular shield, and an electrically insulating outer jacket covering the tubular shield. These requirements complicate the manufacture process and impose additional costs due to the additional conductors and insulator layers needed.

The inventors of the present invention surprisingly found out that the immunity of electrical cables to influence (disturbances) of low frequency (up to 400 Hz) external magnetic fields can be significantly improved by certain design considerations allowing arranging the conductors of the cables in structures that significantly enhance the attenuation factor of the cable to external magnetic fields. The immunity of the self-protective cables disclosed herein is achieved in some embodiments due to substantial reduction in the self-inductance of the cables achieved due to their structures, the arrangement and electrical connectivity of the conductors of the cables. Therefore, cable structure arrangements disclosed herein are generally referred to as self-protected cables, as their enhanced immunity to external magnetic fields is mainly due to their structural features, wires (conductors) arrangement and electrical connectivity, and without using any shielding structures as in the conventional shielded cables.

In a basic configuration of the present disclosure a self-protected cable is provided in which at least one conductor of a conventional cable design is split into two or more sub-conductors that are electrically connected in parallel to each other, the sub-conductors are arranged in the cable such that each sub-conductor is placed adjacent and alongside at least one other conductor or sub-conductor associated with either another electric phase or current direction. Correspondingly, the electric current associated with (e.g., induced in) each conductor of the conventional cable is split into smaller currents associated with the sub-conductors, and each sub-conductor thus associated with a magnetic field of relatively smaller (weaker) magnitude. Preferably, each conductor of the conventional cable design is split into two or more sub-conductors that are electrically connected in parallel to each other, and the sub-conductors are arranged in the cable such that each sub-conductor is placed adjacent and alongside at least one other sub-conductor associated with either another electric phase or current direction.

Preferably, the sub-conductors have more or less the same cross-sectional areas such that an equal portion of the electrical current carried by the conductor in the conventional cable design is carried by each sub-conductor. The sum of the cross-sectional areas of the sub-conductors may be smaller than the cross-sectional area of the at least one conductor of the conventional cable design that was split. Possibly, the sum of the cross-sectional areas of the sub-conductors substantially equals to the cross-sectional area of the conductor of the conventional cable design that was split.

The term low frequency is used herein to refer to frequencies in the range of up to 400 Hz. The term conventional cable design is used herein to refer to properties (e.g., diameter, materials, and conductors arrangements of conventional single-phase of three-phase cable conductors) of conventional electrical cables e.g., power supply cables or cables used for delivery of electric signals. In particular, in the self-protected cables of the present application the electrical current passing through at least one conductor of the conventional cable is split into two or more sub-conductors that are arranged in a structure designed to improve the attenuation factor of the cable.

For example and without being limiting, in one possible embodiment of the present application one conductor of a conventional double-core AC or DC (direct current) cable is split into two sub-conductors, the sub-conductors having substantially the same cross-sectional areas and are electrically connected in parallel to each other such that the electrical current carried by each sub-conductor substantially equals to half of the electrical current passing through the conductor in the conventional cable design. The sub-conductors may be placed at opposing sides and alongside (i.e., in parallel) the other conductor that carries electrical current in the opposite direction. Optionally, the split conductor is split into a plurality of sub-conductors having substantially cross-sectional areas and arranged about the other conductor of the cable such that magnetic moments developing between the sub-conductors and the other conductor of the cable substantially cancel each other.

Alternatively, both conductors of the conventional double-core cable are split into two or more sub-conductors having more or less the same cross-sectional areas, and the sub-conductors are arranged in an intervening manner such that each sub-conductor is placed in the vicinity and alongside one or more sub-conductors associated with either another electrical phase or current direction. For example and without being limiting, each conductor of the dual-core conventional cable may be split into two sub-conductors which cross-sectional areas substantially equals to half of the cross-sectional area of the conductor in the conventional cable, and the sub-conductors are arranged in an intervening manner such that each sub-conductor is placed near and alongside (e.g., between) two other sub-conductors associated with either another electrical phase or electric current direction (e.g., associated with the electric neutral). For instance, the sub-conductors may be arranged to form a square/rectangular or parallelogram shape, or may be arranged on a circumference of a circle such that each sub-conductor is placed between and alongside two other sub-conductors associated with either another electrical phase or electric current direction.

In one aspect of the present application, there is provided a method of improving electric cable immunity to external magnetic fields comprising splitting one or more conductors of the cable into two or more sub-conductors, determining a cross-sectional area for each one of the sub-conductors to obtain a desirable electrical current density therethrough, arranging the sub-conductors in the cable in an intervening fashion such that each sub-conductor is placed adjacent and alongside at least one neighboring sub-conductor carrying another electrical phase or electric current in an opposite direction, and electrically connecting the sub-conductors of each split conductor in parallel.

In some applications arranging of the sub-conductors also includes placing sub-conductors having greater cross-sectional areas closer to a geometric cross-sectional center of the cable, and placing sub-conductors having smaller cross-sectional areas closer to boundaries of a cross-section of the cable.

Various geometrical arrangements may be adopted, for example and without being limiting, the sub-conductors may be arranged to form a square, parallelogram or rectangular structure, or alternatively, the sub-conductors may be arranged on a circumference of a circle. In such circular arrangements, a grounding conductor may be added at a center of the circle. Alternatively, the sub-conductors may be arranged around a central supporting element configured and operable to hold and immobilize the sub-conductors. For example, the central supporting member may be an elongated cylindrical element which diameter substantially equals to a diameter of the sub-conductors.

In some applications the central supporting member may an elongated multipoint star-shaped element configured to define a plurality of elongated indentations therealong, each one of the sub-conductors is received and held in one of the indentations. In this way the distances between the sub-conductors of the self-protected cable may be precisely preset to desirable values, thereby improving the immunity of the cable to external magnetic interferences. However, other configurations of the central supporting element are also possible, for example, in some embodiments the central supporting member is an elongated multipoint asterix-shaped element configured to define a plurality of elongated grooves therealong, each one of the sub-conductors is received and held in one of said grooves. Preferably, arms of the star-shaped or of the asterix-shaped supporting element taper in a radial outward direction towards the coating of the cable.

A ground conductor may be added beside and alongside the sub-conductors of the cable in any of the possible geometrical arrangement of the sub-conductors. Optionally, the ground conductor is embedded inside the supporting element, preferably at its center and passes along its length.

In some possible embodiments of the present application, all conductors and/or sub-conductors of the cable may be enclosed inside at least one neutral conductor (i.e., to be connected to electrical zero/neutral of the electric system) shaped in form of a hollow tube.

The circular arrangements of the sub-conductors may be also used to provide three-phase self-protected cables, by splitting the conductors of the three-phase cable such that each phase is carried by n (a positive integer, n>1) sub-conductors. The sub-conductors may be arranged such that an angle between neighboring sub-conductors on the circumference is about 120°/n relative to an axis of the circular arrangement, and an angle between adjacently located sub-conductors on the circumference carrying the same phase is about 360°/n.

In some other possible circular arrangements of the three-phase cable, a single conductor carrying one electric phase is placed at a center of the cable, and the sub-conductors of all other phases are arranged therearound such that an angle between neighboring sub-conductors situated on the circumference of the circular arrangement is about 180°/n, and an angle between adjacently located conductors carrying the same phase is about 360°/n, where n is the number sub-conductors in each electrical phase.

According to another aspect the present invention is directed to a cable structure arrangement comprising a set of sub-conductors electrically connected to each other in parallel for carrying an electrical current in one direction or of one electric phase, and one or more other sets of sub-conductors, the sub-conductors in each of the other sets are electrically connected to each other in parallel for carrying an electrical current in an opposite direction or of a another electric phase, wherein the sets of sub-conductors are arranged in an intervening manner such that each sub-conductor is placed adjacent and alongside at least one neighboring sub-conductor from the other sets, and the sub-conductors may be therefore arranged such that each sub-conductor is distant from the other sub-conductors belonging to the same set. The number of sub-conductors in each of the sets of sub-conductors may be selected to provide a predetermined magnetic field attenuation factor to at least one of external and self generated magnetic fields.

In some possible embodiments the sub-conductors are arranged to form a square, parallelogram or rectangular structure. Alternatively, the sub-conductors may be arranged on a circumference of a circle.

Optionally, a grounding conductor is added to the cable and placed at a center of the circle (i.e., of the circular arrangement) or beside and alongside the sub-conductors.

The cable arrangement may comprise at least one neutral conductor shaped in form of a hollow tube enclosing all other conductors and/or sub-conductors of the cable.

In possible embodiments of the present invention the cable is a three-phase cable, wherein an angle between neighboring sub-conductors on the circumference of the circle is about 120°/n, and an angle between adjacently located conductors situated on the circumference of the circular arrangement and carrying the same electric phase is about 360°/n, where n is the number of sub-conductors in each electrical phase.

In some other possible embodiments of the three-phase cable, one electric phase is carried by a single conductor placed at a center of a circular arrangement of the cable and the sub-conductors of all other electric phases are arranged on a circumference of the circular arrangement such that an angle between neighboring sub-conductors on the circumference of the arrangement is about 180°/n, and an angle between adjacently located sub-conductors carrying the same phase is about 360°/n, where n is the number sub-conductors in each electrical phase.

Optionally, the cross sectional areas of the sub-conductors are adjusted according to the desired electrical current distribution. In some applications, sub-conductors having greater cross-sectional areas are located closer to a geometric cross-sectional center of the cable, and sub-conductors having smaller cross-sectional areas are located closer to boundaries of a cross-section of the cable.

In some applications, the cross-sectional areas of the sub-conductors is selected such that the total amount of conductor material of the sub-conductors of the cable is smaller than the total amount of conductor material of the un-split conductors in the original/conventional cable design. Accordingly, the splitting of the cable conductors may be carried out such that cross-sectional area of each sub-conductor ($a_{sub}$) is smaller than the cross-sectional area of the un-split conductor ($a_{cond}$) divided by the number (n) of sub-conductors into which the conductor is being split (i.e., $a_{sub}<a_{cond}/n$). Optionally, the electric current carried by each sub-conductor ($I_{sub}$) is greater than the electrical current that the original un-split conductor was designed to carry ($I_{cond}$) divided by the number of sub-conductors (n) into which the conductor been split (i.e., $I_{cond}<I/n$).

In another aspect, the present invention is directed to a method of designing a single-phase or multi-phase electric cable comprising determining for each electric phase of the cable a number n of sub-conductors suitable to achieve a desired distribution of electric current of the electric phase, arranging magnetic dipoles from currents passing through the conductors/sub-conductors and determining value and direction of magnetic moment of each of the magnetic dipoles, adjusting the arrangement of the sub-conductors such that a sum of the magnetic moments is substantially zeroed, and electrically connecting in parallel the sub-conductors of each electric phase.

The method may further comprise estimating magnetic field external to the cable and adjusting an attenuation factor of the external magnetic field by selecting a number n of the sub-conductors.

The method may further comprise adjusting an attenuation of the cable by increasing the number n of the sub-conductors in each electric phase and arranging the sub-conductors in the cable in an intervening fashion such that each sub-conductor is placed adjacent and alongside at least one neighboring sub-conductor associated with either another electric phase or electric current. The arranging may further include placing each sub-conductor distant (e.g., distance greater than a diameter of an adjacently located sub-conductor associated with either another electric phase or electric current direction) from other sub-conductors associated with the same electric phase or electric current direction.

The method may further comprise determining for each sub-conductor a cross-sectional area complying with said desired distribution of electric current.

Optionally, arranging the sub-conductors includes placing sub-conductors having greater cross-sectional areas near a geometric cross-sectional center of the cable, and placing sub-conductors having smaller cross-sectional areas near edges of the cable's cross-section.

In some possible embodiments the attenuation factor of the cable may be increased by increasing the number of sub-conductors in an original design of the cable. Correspondingly, determining of the cross-sectional area for each sub-conductor may include reducing the cross-sectional areas of at least some of the sub-conductors in said original design to thereby obtain a smaller total cross-sectional area than that obtained in said original design. For example and without being limiting, the cross-sectional area of some sub-conductors associated with each electric phase or current direction may be reduced such that the total cross-sectional area of the sub-conductors is smaller than a cross-sectional area of conductors associated with said electric phase or current direction in an original design of the cable.

The method may comprise adding a grounding conductor to the cable, wherein the grounding conductor is located at a geometrical cross-sectional center of the cable or adjacent and alongside the arranged sub-conductors.

In possible embodiments of the present invention all of the sub-conductors and conductors are enclosed within a hollow electrically conducting element serving as a neutral conductor of the cable.

BRIEF DESCRIPTION OF THE DRAWINGS

In order to understand the invention and to see how it may be carried out in practice, embodiments will now be described, by way of non-limiting example only, with reference to the accompanying drawings, in which like elements are designated by the same reference numerals, and in which:

FIG. 1 shows a cross-sectional view of a conventional single-phase cable without a grounding conductor;

FIG. 2 shows a cross-sectional view of a single-phase cable according to one possible embodiment of the present disclosure (single-phase cable of type A);

FIG. 3A to FIG. 3G show various configurations of a single-phase cable of the present application, where FIG. 3A is a cross-sectional view of an implementation of the cable without a grounding conductor, FIG. 3B and FIG. 3C exemplify possible implementations of the cable with a grounding conductor, FIGS. 3D to 3F illustrate various embodiments employing a central supporting element to hold and immobilize the sub-conductors inside the cable, and FIG. 3G demonstrates possible electrical connectivity of the cable shown in FIG. 3B;

FIG. 5A is a cross-sectional view of a possible implementation of the cable without a grounding conductor, FIG. 5B to FIG. 5D exemplify possible implementations of the cable with a grounding conductor, FIGS. 5E to 5G illustrate various embodiments employing a central supporting element to hold and immobilize the sub-conductors inside the cable, FIG. 5H exemplifies embedding the ground conductor in central supporting element and FIG. 5I demonstrates possible connectivity of the cable embodiment shown in FIG. 5A;

Figure 3C:
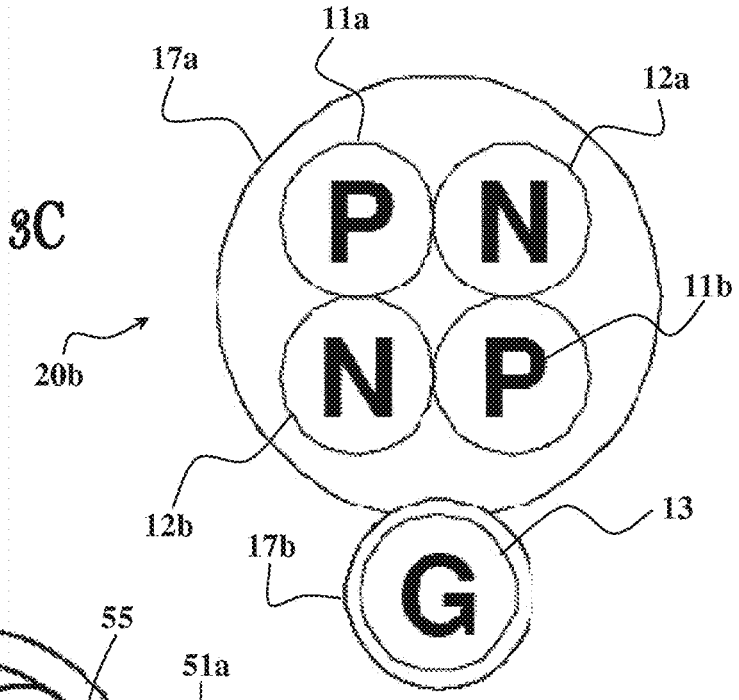

It is noted that the embodiments exemplified in the figures are not intended to be in scale and are in diagram form to facilitate ease of understanding and description.

DETAILED DESCRIPTION OF EMBODIMENTS

The present application provides self-protective single and multi-phase electric cables which are substantially immune to external magnetic fields. The cables designs disclosed herein also provide cables producing substantially weak external magnetic fields when electrically loaded. In general, at least one conductor of these self-protective cables is split into two or more electrically insulated sub-conductors which are electrically connected in parallel to each other. Optionally, the sum of cross-sectional areas of the sub-conductors associated with a certain electric phase or current direction substantially equal to a design cross-sectional area of the conductor associated with said certain electric phase or current direction that has been split. The conductors and sub-conductors are arranged in the self-protective cables such that each conductor/sub-conductor is located adjacent to and alongside at least one conductor/sub-conductor associated with either a different phase or a different current direction (polarity). Accordingly, in some embodiments, the conductors and sub-conductors may be arranged in the self-protected cables such that each conductor/sub-conductor is located relatively distant from conductors/sub-conductors associated with either same electric phase or same current direction.

FIG. 1 schematically illustrates a cross-sectional view of a conventional cable design 10 (e.g., single-phase AC cable or a DC cable) having two conductors/wires 11 and 12 carrying electrical currents of different electrical phases or directions/polarities. In such conventional cable designs the conductors 11 and 12 typically have the same cross-sectional areas $S_{main}$. FIG. 1 and the following self-protected cables shown in FIGS. 2-7 exemplify single-phase cables, wherein the phase conductors/sub-conductors are designated by the letter "P", and wherein neutral ("0") conductors/sub-conductors by the letter "N". As exemplified in FIG. 1, electrical field $U_{12}$ typically evolves between the conductors 11 and 12 due to the electrical currents passing through them.

The term dipole as used herein refers to a pair of electrical currents having equal magnitudes and opposite directions (polarities) and passing through a pair of adjacent conductors/sub-conductors in the cable. A magnetic moment $\overline{M}$ of a dipole is a vector which can be expressed by the equation $\overline{M}=\mu_0\cdot\dot{I}\cdot D\cdot l_0\cdot\overline{n}_0$, where:

$\mu_0$ is the magnetic permeability of vacuum;

I is the value of one of the equal and opposite currents in the dipole;

$\dot{I}$ indicates a complex value designating an alternating electrical current having a phase factor;

D is the distance between the parallel wires/conductors in the dipole;

$l_0$ is one unit of length of the wire; and $\overline{n}_0$ is a unit vector that is perpendicular to a plane defined by elementary lengths of the conductors in which the electrical currents of the dipole are passed (the direction of vector $\overline{n}_0$ can be defined by the right gimlet rule).

FIGS. 2 to 7 schematically illustrate various possible embodiments of single-phase self-protective cables of the present invention. As illustrated in these figures, some of the self-protective cables embodiments include a ground conductor (G) which may be either:

- located alongside the active conductors/sub-conductors arrangement of the self-protective cables within the electrically insulating jacket of the cable, to maintain a round shape of the cable; or
- located apart from the active conductors/sub-conductors arrangement of the self-protective cable, outside and alongside the jacket of the cable.

FIG. 2 exemplifies a possible embodiment of a single-phase cable 30 (single-phase cable of type A) of the present application wherein one of the conductors (e.g., conductor 11 shown in FIG. 1) is split into two sub-conductors 11*a* having smaller cross-sectional areas (e.g., $\sim S_{main}/2$, about half of the cross-sectional area of un-split conductor 11 of the conventional single-phase cable design) connected in parallel such that the electrical current passing through each of the sub-conductors 11*a* is about half (~I/2) of the electrical current passing through the un-split wire (11 in FIG. 1). In this non-limiting example the sub-conductors 11*a* are arranged in the cable 30 in parallel and alongside the active conductor 12, and at opposing sides thereof.

As exemplified in FIG. 2, in this configuration voltages $U_{12}$ and $U_{12}'$ evolving between the active conductor 12 and the sub-conductors 11*a* are of same magnitudes and opposite directions such that they substantially cancel each other, $U_{12}+U_{12}'=0$.

Similarly the sum of the magnetic moments evolving due to the magnetic field generated by conductor 12 and the sub-conductors 11*a* is also substantially zeroed, $\vec{M}_1+\vec{M}_2+\vec{M}_2'=0$.

FIGS. 3A to 3F illustrate various configurations of a self-protective cable wherein each of the conductors (e.g., conductors 11 and 12 of conventional single-phase cable design 10 of FIG. 1) is split into two sub-conductors (e.g., 11*a* and 12*a* in FIGS. 3A to 3C) each having a cross sectional area that is smaller than the cross-sectional area of the (unsplit) conductors in the conventional single-phase cable design (e.g., $\sim S_{main}/2$). The self-protective cable 20 exemplified in FIG. 3A includes two pairs of sub-conductors, 11*a* and 12*a*, the sub-conductors of each pair are electrically connected in parallel such that the electrical current passing through each sub-conductor is about half (~I/2) of the magnitude of the electrical current that would pass through the (unsplit) conductor in the conventional single-phase cable design shown in FIG. 1.

In this non limiting example, the pairs of sub-conductors 11*a* and 12*a* are arranged in a symmetric structure such that the sub-conductors of each pair are placed in opposing positions in the self-protected cable. The sub-conductors 11*a* and 12*a* may be tightly enclosed inside the electrically insulating jacket 17 of the cable 20, optionally such that their electrically insulating coatings 16 are contacted, or pressed against each other. In this way, a square or parallelogram structure is formed in which the sub-conductors of each pair of sub-conductors is located at opposing apexes of the square/parallelogram structure.

FIGS. 3B and 3C demonstrate implementations of the self-protective cable shown in FIG. 3A having a grounding conductor ("G") 13. In the self-protective cable 20*a* shown in FIG. 3B the grounding conductor 13 is placed inside the electrically insulating jacket 17, in close proximity with, and alongside, the square/parallelogram structure of the sub-conductors 11*a* and 12*a*. In the self-protective cable 20*b* shown in FIG. 3C the grounding conductor 13 is covered by a separate electrically insulating jacket 17*b* and located outside and alongside the electrically insulating jacket 17*a* of the cable 20*b*. It is noted that since the grounding conductor 13 has negligible effect on the magnetic/electric fields produced by the cable and/or induced in its conductors various different locations thereof in/alongside the cable configuration may be contemplated without departing from the scope and spirit of the invention.

In some possible embodiments, the sub-conductors of the single-phase self-protected cables are arranged inside the cables on a circumference of a circle, around a supporting element centrally positioned inside the cable. The supporting element is configured and operable to guarantee that the position of the sub-conductors do not shift (displace) inside the cable, and thereby maintain a predetermined arrangement of the conductors and their exact location thereinside. In use, some of the sub-conductors of the cable are electrically connected to an electrical phase, and some other sub-conductors of the cable are electrically connected to an electrical neutral. The sub-conductors electrically connected to the electric phase and the sub-conductors electrically connected to the electric neutral are selected such that each sub-conductor carrying the electric phase of the cable is situated near at least one other sub-conductor carrying the electric neutral. For example, in the circular arrangements exemplified in some of the figures the sub-conductors may be selected such that sub-conductors carrying the electric phase are situated between two adjacent sub-conductors carrying the electric neutral.

Figure 3D:
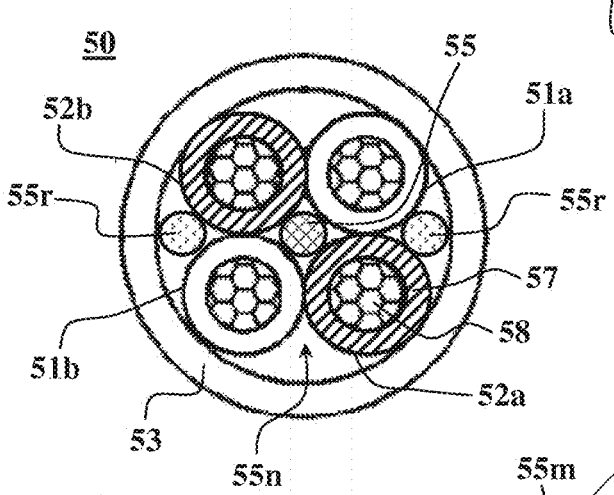

FIG. 3D exemplifies a single-phase self-protected cable 50 having four electrically insulated sub-conductors 51*a*, 52*a*, 51*b* and 52*b* arranged in the cable 50 around a supporting element 55 in a rectangular form, where two sub-conductors 51*a* and 51*b* are electrically connected to the electric phase carried by the cable 50, and two other sub-conductors 52*a* and 52*b* are electrically connected to the electric neutral. In this arrangement, each one of the two sub-conductors 51*a* and 51*b* electrically connected to the electrical phase of the cable 50 is situated circumferentially between two other sub-conductors 52*a* and 52*b* electrically connected to the electric neutral.

The single-phase self-protected cable 50 may comprise one or more rip-cords 55*r* disposed between the jacket 53 (e.g., electrically insulating jacket such as Flame Retardant PVC compound jacket) and the sub-conductors of the cable 50. The rip-cords 55*r* may be placed under the jacket 53 along any of the outer channels 55*n* formed along the cable by adjacently situated sub-conductors, and are used to facilitate the tearing of the jacket 53 e.g., when there is a need to remove a portion of the jacket 53. The rip-cords 55*r* may be further used to help to maintain the sub-conductors in their locations inside the cable and prevent displacement of the sub-conductors thereinside.

As seen in FIG. 3D the sub-conductors in cable 50 comprise an electrically insulating cover 57, which in this example encloses a strand of electrically conducting wires 58 (e.g., flexible copper wires).

Figure 3E:
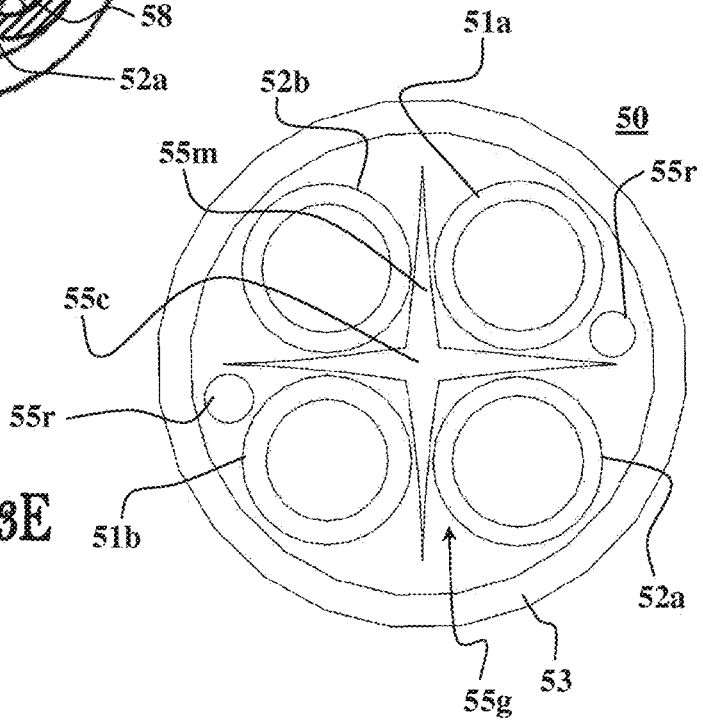

FIG. 3E exemplifies another possible embodiment wherein the sub-conductors are 51*a*, 52*a*, 51*b* and 52*b*, are held inside the cable 50 by the arms 55*m* of an elongated cross-shaped supporting element 55*c*. More particularly, in this embodiment each pair of adjacent elongated arms of the elongated cross-shaped supporting element 55*c* defines an elongated groove 55*g* configured to hold and immobilize one of the sub-conductors 51*a*, 52*a*, 51*b* and 52*b*, therein.

The arms 55*m* of the cross-shaped supporting element 55*c* may taper in a radial outward direction towards the jacket 53 of the cable 50, to thereby improve the flexibility of the cable 50. In this way, precise preset distances between the sub-conductors of the cable 50 are maintained while preventing migration of the sub-conductors thereinside (e.g., to provide for substantive cancelation of magnetic fields applied thereover).

Figure 3F:
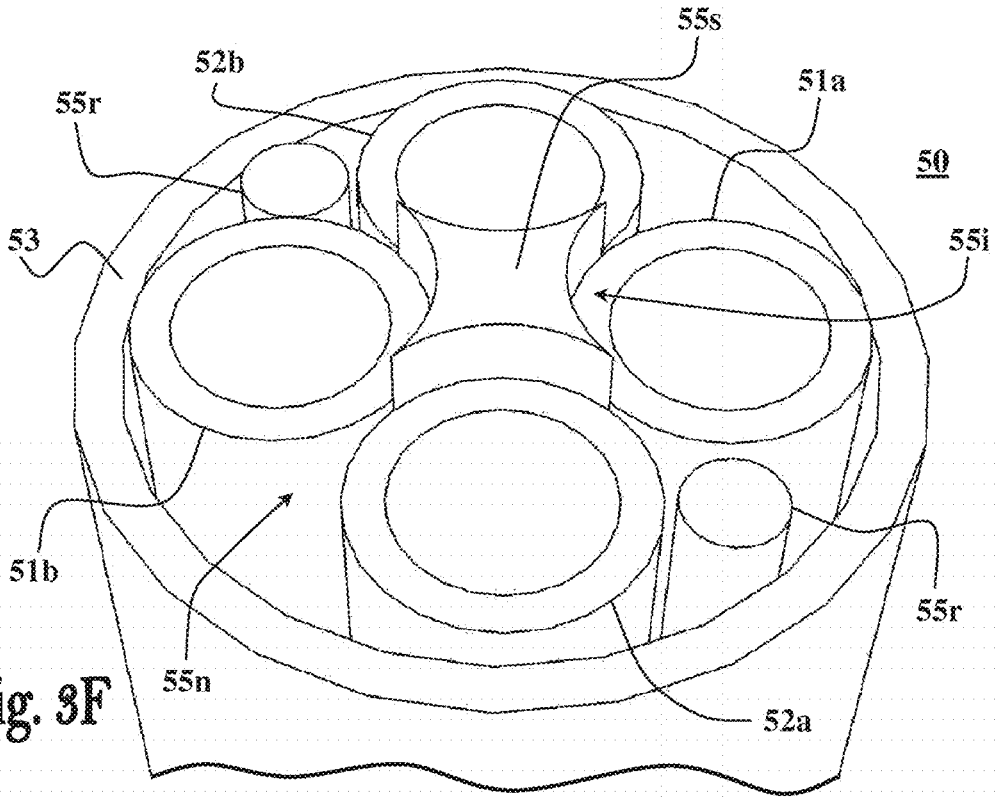

FIG. 3F shows a possible embodiment of cable 50 wherein the conductors 51*a*, 52*a*, 51*b* and 52*b*, of the cable are held in circular indentations 55*i* of an elongated supporting element 55*s* having a four apex star shape. As seen, with this configuration the locations and geometrical arrangement of the sub-conductors 51*a*, 52*a*, 51*b* and 52*b*, can be accurately maintained since the conductors 51*a*, 52*a*, 51*b* and 52*b*, are pressed by the jacket 53 into the circular indentations 55*i* of the star-shaped supporting element 55*s*, and thereby prevent any movement of the conductors inside the cable 50. The single-phase self-protected cables 50 shown in FIGS. 3E and 3F may also include rip-cords 55*r*, disposed between the sub-conductors and the jackets 53 of the cables. The supporting elements 55, 55*c* and 55*s*, shown in FIGS. 3D to 3F, may be fabricated from any suitable soft, flexible or elastic, material (e.g., FR-PVC, FR-LSZH), for example, by extrusion.

Figure 3G:
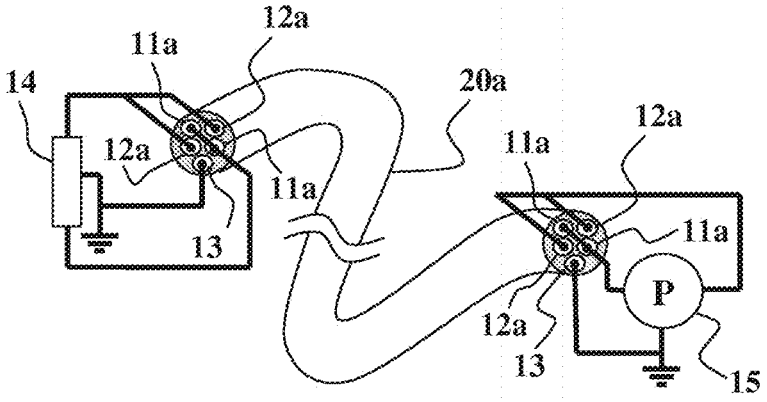

FIG. 3G schematically illustrates electrical connection of the self-protective cable 20*a* shown in FIG. 3B. In this example, each pair of oppositely positioned sub-conductors 11*a* and 12*a* of the self protective cable 20*a* is electrically connected in parallel. More particularly, at one end of the self-protective cable 20*a* the pairs of sub-conductors 11*a* and 12*a* and the grounding conductor 13 are electrically connected to respective power supply and ground terminals of the power source 15, and at its other end the pairs of sub-conductors and the grounding conductor are electrically connected to respective power input and ground terminals of the electric load 14. As seen, the sub-conductors 11*a* situated at opposing locations inside the cable are electrically connected in parallel, and similarly the sub-conductors 12*a* situated at opposing locations are also electrically connected in parallel.

Figure 4:
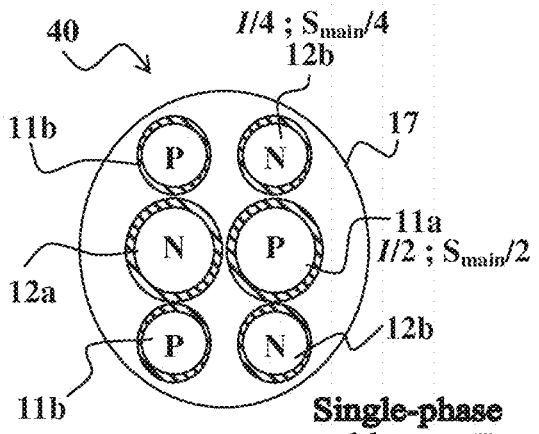
FIG. 4 shows a cross-sectional view of a single-phase cable according to one possible embodiment of the present disclosure (single-phase cable of type B)

Another possible embodiment of the present disclosure is illustrated in FIG. 4 (single phase cable of type B), wherein there is shown a self-protective cable 40 in which each conductor of the conventional single-phase cable design shown in FIG. 1, is split into three sub-conductors electrically connected in parallel (also referred to herein as a triplicate), and wherein the sub-conductors are arranged in a rectangular structure in which each sub-conductor is position adjacent to and alongside, or in contact with electrically insulating coatings of, sub-conductors associated with electrical current of different electric phase or current direction/polarity.

In this example, each conductor of the conventional single-phase cable design is split into three sub-conductors, two of which (e.g., 11*b* or 12*b*) having a cross-sectional area that is about a quarter ($\sim S_{main}/4$) of the cross-sectional area of the (unsplit) conductor in the conventional single-phase cable design, and the third sub-conductor (e.g., 11*a* or 12*a*) has a cross-sectional area that is about half ($\sim S_{main}/2$) the cross-sectional area of the (unsplit) conductor in the conventional single-phase cable design. Thus, the electrical current (I) that passes through each triplicate of parallelly connected sub-conductors of self-protective cable 40 is distributed such that about a quarter of the electrical current (~I/4) passes through each of the sub-conductors having a quarter cross-sectional area (11*b* or 12*b*), and about half of the electrical current (~I/2) passes through the sub-conductor having half cross-sectional area (11*a* or 12*a*).

The sub-conductors may be arranged in an adjacently located in a rectangular structure (or parallelogram) comprising two columns and three rows, and being enclosed in an electrically insulating jacket 17, such that the sub-conductor having a half cross-sectional area of each triplicate (11*a* or 12*a*) is positioned in a center of a column, and a pair of sub-conductors of a quarter cross-sectional areas (11*b* or 12*b*) of the other triplicate (i.e., associated with a different electrical phase or current direction) are positioned at opposite sides of the column. Each sub-conductor may have an electrically insulating coating such that the sub-conductors may be compactly enclosed inside the electrically insulating jacket 17, optionally is close proximity such that their electrically insulating coatings are in contact.

It is noted that other current/cross-sectional area distributions may be used in each triplicate of sub-conductors. For example and without being limiting, the sub-conductors currents/cross-sectional areas in each triplicate may be distributed as follows: [⅕, ⅗, ⅕], [⅔, ⅔, ⅓], [⅓, ⅓, ⅓] or using any other suitable distribution. It is however noted that better attenuation factors may be obtained in such two-columns three-rows rectangular (parallelogram) arrangements when positioning a sub-conductor of a greater cross-sectional area (e.g., $\sim S_{main}/2$) at the center of each column, as exemplified in FIG. 4.

FIGS. 5A to 5D schematically illustrate various embodiments of self-protective cables of the present application in which each conductor of the conventional single-phase cable design shown in FIG. 1 is split into three sub-conductors arranged on a circumference of a circle, wherein sub-conductors carrying the electric phase of the cable are circumferentially located in this circular arrangement between two neighboring sub-conductors carrying an electric neutral or an electrical current of the opposite direction. In order to maximize the attenuation factor and obtain a symmetrical arrangement of the sub-conductors the cross-sectional area of each sub-conductor may be about a third ($\sim S_{main}/3$) of the cross-sectional area of the conductor in the conventional single-phase cable design shown in FIG. 1, such that the electrical current that passes through each sub-conductor is more or less a third (~I/3) of the current that passes through the conductor in the conventional single-phase cable design.

Figure 5A:
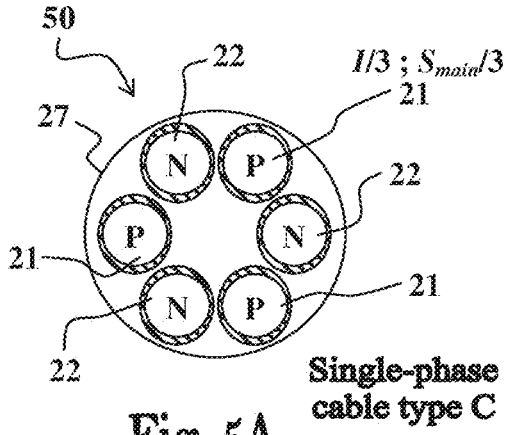
FIG. 5A to FIG. 5I show various configurations of a single-phase cable of the present application (single-phase cable of type C), where

FIG. 5A exemplifies a possible self-protective cable 50 of the present disclosure without a grounding conductor. In this embodiment the sub-conductors triplicates 21 and 22 are circularly arranged within the electrically insulating jacket 27 in an intervening fashion, such that each phase carrying sub-conductor is located circumferentially between and alongside two neighboring sub-conductors of the other triplicate of sub-conductors (e.g., carrying the electric neutral). In order to improve the attenuation factor of self-protective cable 50 the sub-conductors triplicates 21 and 22 may be tightly arranged in this circular arrangement such that the electrical insulating coating of neighboring sub-conductors are in physical contact.

Figure 5B:
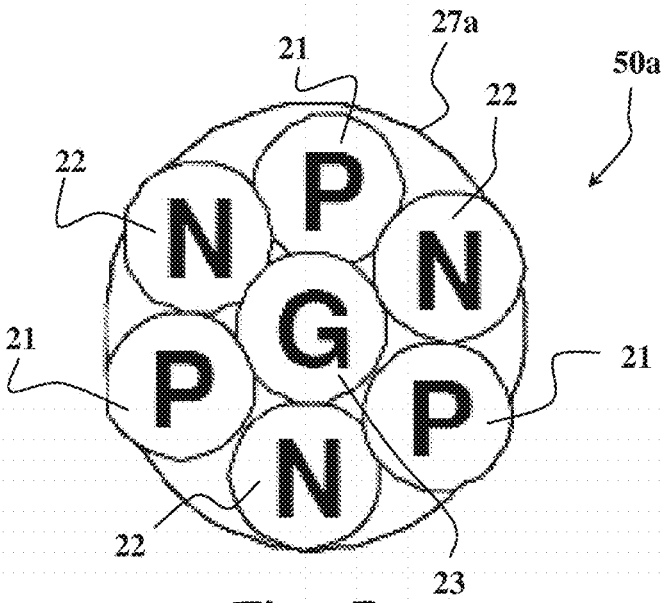

FIG. 5B exemplifies another self-protective cable embodiment 50*a*, in which two sub-conductors triplicates are circularly arranged within an electrically insulating jacket 27*a*, as in FIG. 5A (i.e., sub-conductors of each triplicate is located circumferentially between and alongside two neighboring sub-conductors of the other triplicate of sub-conductors), but with an additional conductor ("G") 23 positioned at the center of the circular arrangement and serving as an electrical grounding conductor. Optionally, the sub-conductors are tightly arranged in the electrically insulating jacket 27*a* of the cable 50*a* such that the electrically insulating coatings of adjacently located sub-conductors are in contact. In this way, the sub-conductors triplicates 21 and 22 may be arranged such that their electrically insulating coatings are pressed against the electrically insulating coating of the grounding conductor 23.

Figure 5C:
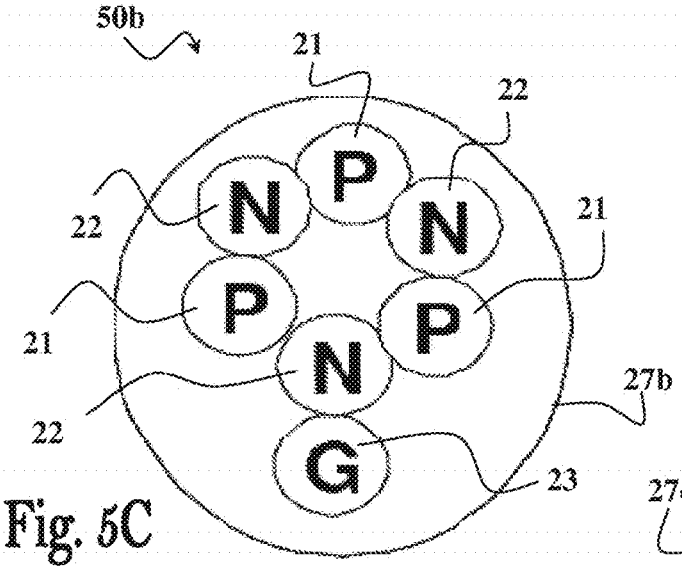
Figure 5D:
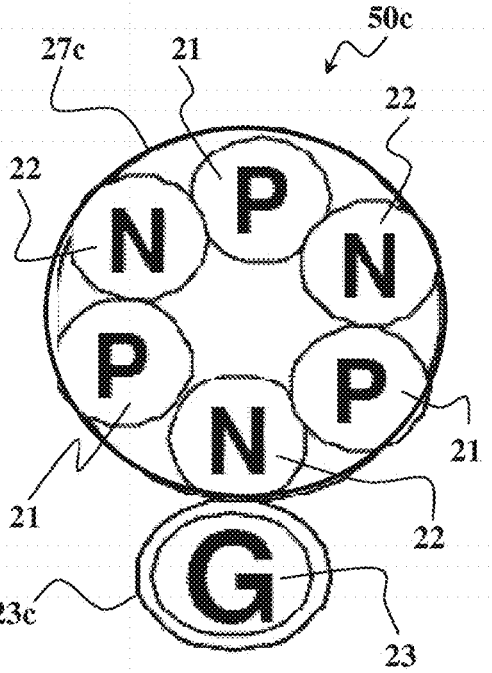

FIGS. 5C and 5D schematically illustrate possible self-protective cable configurations wherein the grounding conductor 23 is not inside the circle about which the active sub-conductors are arranged. In the self-protective cable 50*b* shown in FIG. 5C, the grounding conductor 23 is located within the electrically insulating jacket 27*b*, near the circular arrangement of the active sub-conductors triplicates 21 and 22, and in FIG. 5D the grounding conductor 23 enclosed inside separate electrically insulating jacket 23*c* is located outside and alongside the electrically insulating jacket 27*c* of the self-protective cable 50*c*.

FIGS. 5E to 5H schematically illustrate a single-phase self-protected cable 60 according to some possible embodiments comprising six electrically insulated sub-conductors 61*a*, 62*a*, 61*b*, 62*b*, 61*c* and 62*c*. The sub-conductors in the cable 60 are arranged in a circular form around a central supporting element 65 that prevents displacement of the sub-conductors inside the cable 60 and guarantees that the geometrical arrangement of the sub-conductors remains unchanged thereinside. The supporting element 65 of single-phase cable 60 shown in FIG. 5E has a circular cross-sectional shape and its diameter substantially equals to a diameter of the sub-conductors 61*a*, 62*a*, 61*b*, 62*b*, 61*c* and 62*c*. In this way, each one of the sub-conductors is pressed by the jacket 53 of the cable against the supporting element 65 while simultaneously being laterally pressed by the two adjacently located sub-conductors, thereby preventing movement and substantially immobilizing the sub-conductors inside the cable 60.

In use, three of the sub-conductors (e.g., 61*a*, 61*b* and 61*c* having a 120° angular displacement between each other) of the single-phase cable 60 are electrically connected in parallel to each other and to an electric phase of the cable, while the other three sub-conductors (e.g., 62*a*, 62*b* and 62*c* also having a 120° angular displacement between each other) are separately electrically connected to each other in parallel and to the electric neutral. The sub-conductors connected to the electric phase and neutral are selected such that each one of the sub-conductors that carries the electric phase is situated inside the cable 60 circumferentially between two other sub-conductors carrying the electric neutral.

Figure 5E:
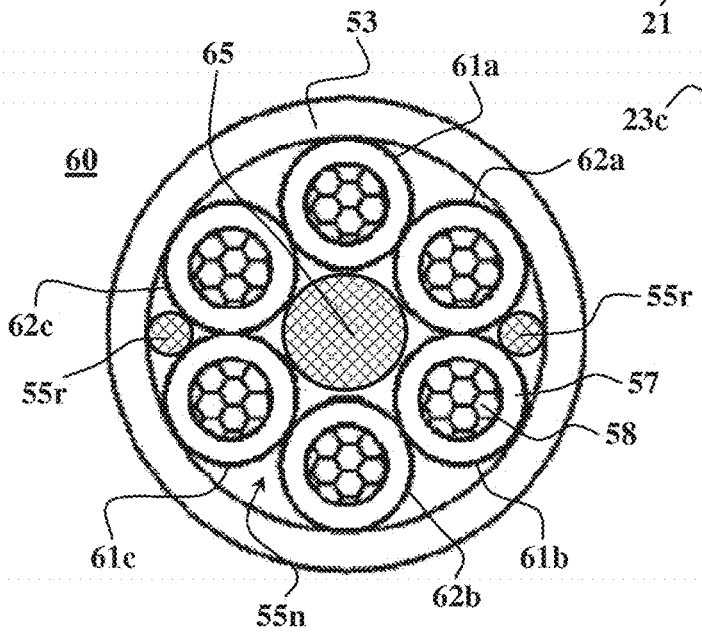
Figure 5F:
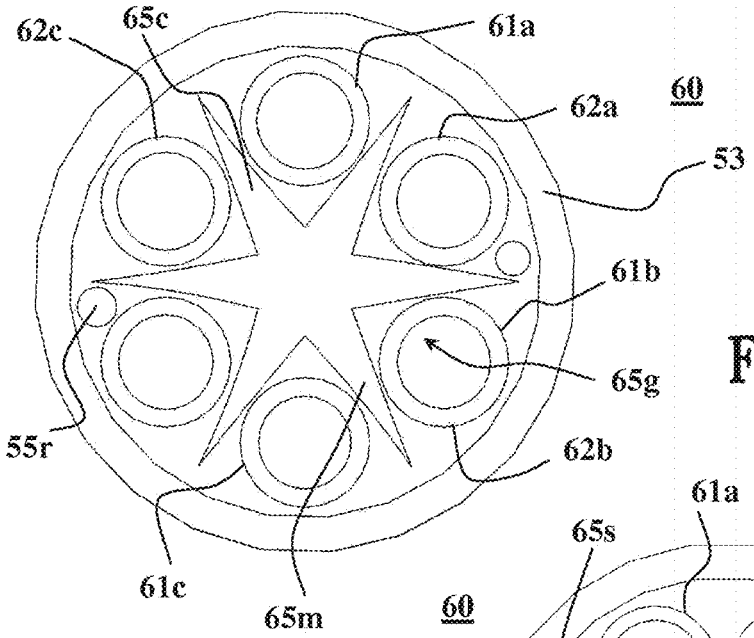

FIG. 5F schematically illustrates a possible embodiment of a single-phase cable 60 in which the sub-conductors 61*a*, 62*a*, 61*b*, 62*b*, 61*c* and 62*c* are held in elongated grooves 65*g* of a six-point asterix-shaped supporting element 65*c*. More particularly, in this embodiment each pair of adjacent elongated arms 65*m* of the elongated asterix-shaped supporting element 65*c* defines an elongated groove 65*g* capable of holding and immobilizing one of the sub-conductors 61*a*, 62*a*, 61*b*, 62*b*, 61*c* and 62*c*, therein, as it is being pressed by the jacket 53 against the pair of arms between which the elongated groove 65*g* is confined. As seen in FIG. 5F, the arms 65*m* of the supporting element 65*c* may taper in a radial outward direction towards the jacket 53 of the cable 60, to thereby improve the flexibility of the cable 60.

Figure 5G:
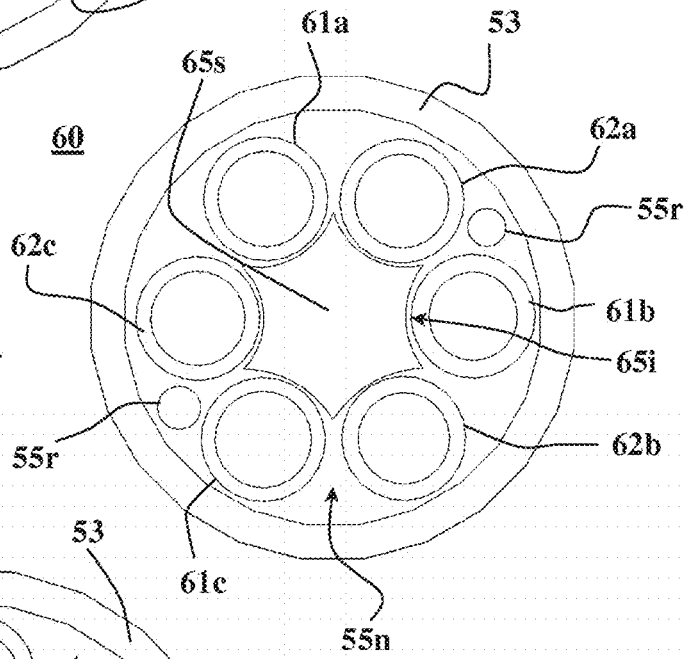

FIG. 5G schematically illustrates a possible embodiment of a single-phase cable 60 wherein the sub-conductors 61*a*, 62*a*, 61*b*, 62*b*, 61*c* and 62*c* are held in elongated circular indentations 65*i* of a six-apex star-shaped supporting element 65*s*. This configuration guarantees that the position of the conductors 61*a*, 62*a*, 61*b*, 62*b*, 61*c* and 62*c*, remain unchanged inside the cable 60, as the external jacket 53 of the cable presses the conductors against the respective indentations 65*i* in which they are retained.

The single-phase self-protected cables 60 shown in FIGS. 5E to 5G may further comprise one or more rip-cords 55*r* placed under the jacket 53 along elongated channels 55*n* formed inside the cable therealong by adjacently situated conductors. As explained above, the rip-cords 55*r* facilitate the tearing of the jacket 53, whenever there is a need to remove a portion of the jacket 53, and may be further employed to restrain the sub-conductors thereinside and prevent them from moving under the jacket 53. In some embodiments, the rip-cords 55*r* may be made from any type of non absorbing fire retardant electrically insulating material.

It is noted that the supporting elements employed in the self-protective cables of the present invention may be implemented in various forms and shapes, and are not limited to the examples shown in FIGS. 3D-3F and 5E-5G. For example, the supporting elements may be implemented by one or more elongated flat elements interposed in the cables between the sub-conductors, or by any suitable filler material that can be introduced into the cable and maintain the desired structure of the sub-conductors arrangement thereinside. It is further noted that the use of such supporting elements to hold and immobilize the sub-conductors inside the cables substantially improves the accuracy of the sub-conductors arrangement structure and consequently further improves the immunity of the cables to external interfering magnetic fields. The supporting elements used in the cables 50 and 60 may be fabricated from a soft, flexible or elastic, material (e.g., non absorbing Fire Retardant electrically insulating material), for example, by extrusion.

Figure 5H:
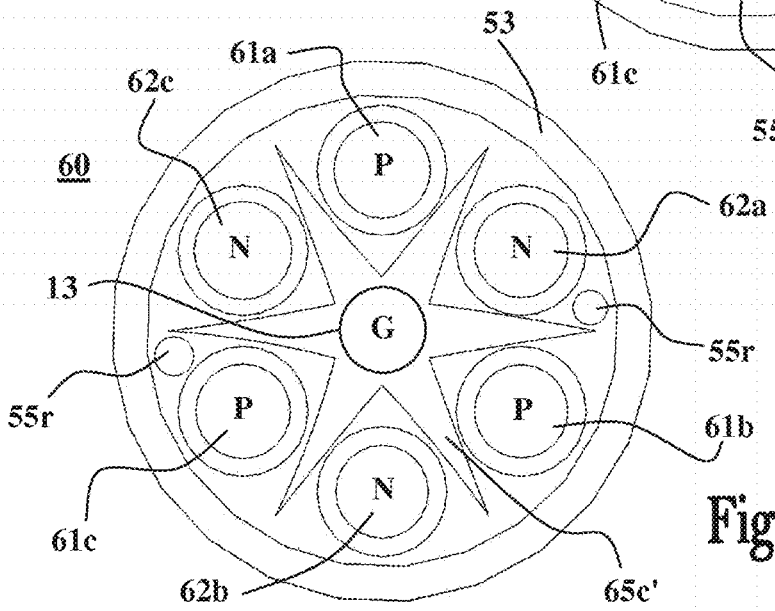

FIG. 5H exemplified a possible embodiment of the single-phase self-protected cable 60, as shown in FIG. 5F, in which the grounding conductor 13 is embedded inside the elongated asterix-shaped supporting element 65*c*'. As seen, the grounding conductor 13 is situated inside the center of the asterix shape of the supporting element 65*c* and passing along its length. The supporting element 65*c* may thus serve for electrically insulating the grounding conductor 13, which therefore may not require further electrically coating. In a similar fashion, the grounding conductor may be embedded inside the supporting elements 65 and 65*s* shown in FIGS. 5E and 5G, respectively.

Figure 5I:
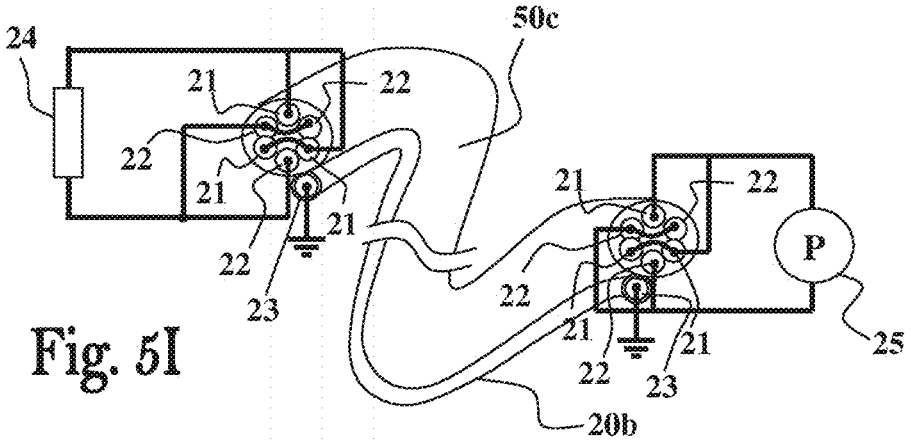

FIG. 5I schematically illustrates electrical connection of the self-protective cable 50*c* shown in FIG. 5D. In this example, the sub-conductors of each triplicate of sub-conductors 21 and 22 (having a 120° angular displacement between each other) of the self protective cable 50*c* are electrically connected to each other in parallel. More particularly, at one end of the self-protective cable 50*c* the sub-conductors triplicates 21 and 22 are electrically connected to respective power supply terminals of the power source 25, and at its other end the sub-conductors triplicates are electrically connected to respective power input of the electric load 24. At each end of the self protective cable 50*c* the grounding conductor 23 is electrically connected to the respective ground of the power source 25 and of the electric load 24.

Figure 6A:
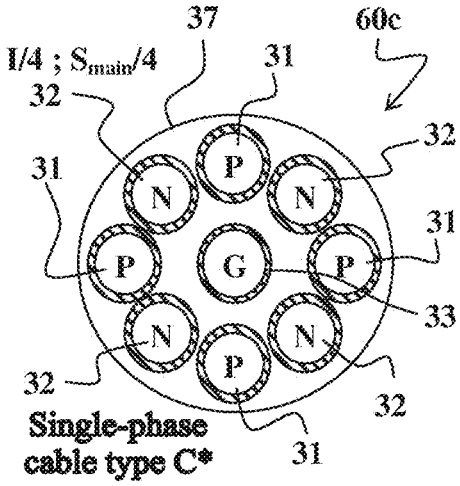
FIG. 6A and FIG. 6B shows cross-sectional views of single-phase cable according to some possible embodiments of the present disclosure, where FIG. 6A exemplifies a circular arrangement of the cable wires (single-phase cable of type C*) and FIG. 6B exemplifies a rectangular arrangement of the cable' conductors/sub-conductors.
Figure 6B:
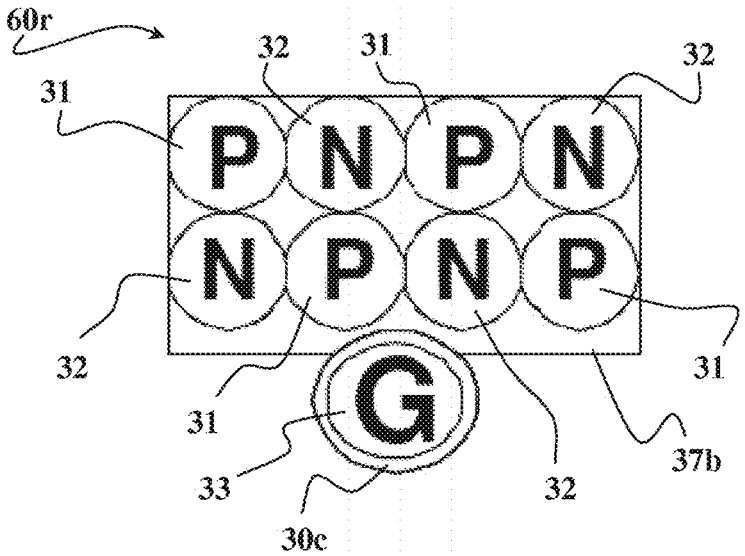

FIGS. 6A and 6B illustrate possible embodiments of a self-protective cable of the present application wherein each conductor of the conventional single-phase cable design shown in FIG. 1 is split into four sub-conductors which are electrically connected in parallel, such that two groups (also referred to herein as quads) of sub-conductors are obtained. The cross-sectional area of each of the sub-conductors may be more or less the same such that the current that pass through each sub-conductor is about a quarter (~I/4) of the current that passes through the conductor in the conventional cable design shown in FIG. 1. Optionally, the cross-sectional area of each of the sub-conductors more or less equals to a quarter (~$S_{main}$/4) of the cross-sectional area of the conductor in the conventional single-phase cable design shown in FIG. 1.

FIG. 6A demonstrates a circular intervening arrangement of the sub-conductors quads 31 and 32 of cable 60*c* (single-phase cable of type C*) in which each sub-conductor is located circumferentially between and alongside two neighboring sub-conductors of the other quad (i.e., carrying electrical currents of the opposite direction). For example and without being limiting, a 90° angular displacement is achieved between adjacent sub-conductors belonging to the same quad. In order to improve the attenuation factor of the self-protective cable 60*c* the sub-conductors 31 and 32 may be tightly arranged inside the electrically insulating jacket 37 of the cable 60*c*, such that the electrically insulating coatings of neighboring sub-conductors are physically contacted. If a grounding conductor 33 is needed, it may be placed at the center of the circular arrangement, as exemplified in FIG. 6A. Alternatively, the grounding conductor 33 may be placed external to the circular arrangement but within the electrically insulating jacket 37 and alongside the cable's sub-conductors, in a similar manner to that exemplified in FIGS. 3B and 5C, or alternatively external to the electrically insulating jacket 37, in a similar manner to that exemplified in FIGS. 3C and 5D.

FIG. 6B demonstrates a single-phase self-protective cable 60*r* employing a rectangular (or parallelogram) intervening arrangement of the sub-conductors quads 31 and 32, such that each sub-conductor is positioned adjacent and alongside sub-conductors associated with electrical current of a different direction (i.e., belonging to the other quad). More particularly, in this example the sub-conductors 31 and 32 are arranged in two adjacently located rows, each comprising four sub-conductors. Accordingly, the electrically insulating jacket 37*b* enclosing the sub-conductors quads 31 and 32 may assume a rectangular shape. Further shown in FIG. 6B, the grounding conductor 33 may be placed external to the rectangular arrangement of sub-conductors and their electrically insulating jacket 37*b* of self-protective cable 60*r*.

Figure 7:
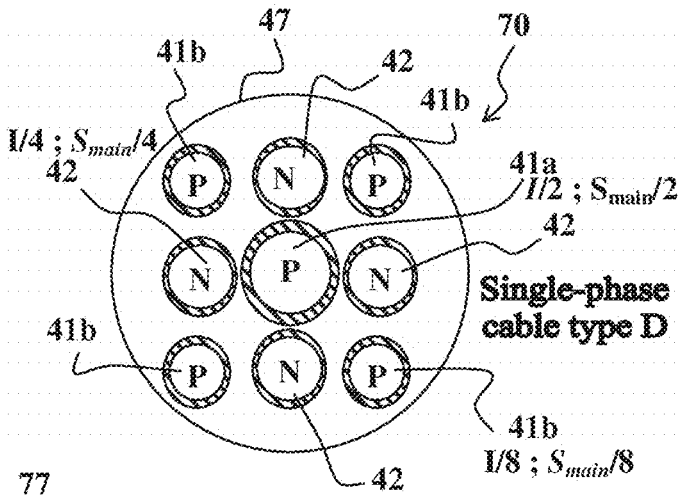
FIG. 7 shows a cross-sectional view of a single-phase cable according to some possible embodiments of the present disclosure (single-phase cable of type D)

A quadratic cable structure arrangement 70 of sub-conductors is exemplified in FIG. 7, wherein one conductor of the conventional single-phase cable design shown in FIG. 1 is split into a first group of four sub-conductors 42 carrying electrical currents in one direction, and the other conductor of the conventional single-phase cable design is split into a second group of five sub-conductors 41*a* and 41*b* (collectively referred to herein as 41) carrying electrical currents in the opposite direction. An intervening arrangement of the sub-conductors may be obtained by positioning each sub-conductor adjacent and alongside neighboring sub-conductors of the other group of sub-conductors (i.e., carrying electrical current in the opposite direction), by arranging the five sub-conductors of the first group of sub-conductors 41 to form an "X" shape, while arranging the four sub-conductors of the second group 42 to from a "+", shape such that each sub-conductor 42 is located at a center of a side of the quadratic arrangement 70.

In this self-protective cable 70 the sub-conductors 42 of the second group have more or less the same cross-sectional areas (e.g., ~$S_{main}$/4), such that each sub-conductor 42 carries about a quarter (~I/4) of the total electrical current that this group of sub-conductors passes. In order to improve the attenuation factor of self-protective cable 70, the sub-conductors of the first group 41 may be configured such that the sub-conductor 41*a* positioned at the center of the quadratic arrangement 70 has greater cross sectional-area than the cross-sectional areas of the other sub-conductors 41*b* of the first group. In this example, the cross-sectional areas of the sub-conductors 41*b* is about a quarter of the cross-sectional area of the sub-conductor 41*a* positioned at the center of the quadratic arrangement 70.

In this configuration the electrical current that passes through each sub-conductor 41*b* is about one eighth (I/8) of the current that passes through the conductor in the conventional single-phase cable design, and the electrical current that passes through the sub-conductor 41*a* positioned at the center of the quadratic arrangement 70 is about half of the current that passes through the conductor in the conventional single-phase cable design. Accordingly, the cross-sectional areas of the sub-conductors 41*b* may be about eighth of the cross-sectional area of a conductor in a conventional single-phase cable design (~$S_{main}$/8) and the cross-sectional area of the sub-conductor 41*a* positioned at the center may be about half of the cross-sectional area of a conductor in a conventional single-phase cable design (~$S_{main}$/2).

The sub-conductors 41 and 42 may be tightly arranged inside the electrically insulating jacket 47 such that their electrically insulating coatings are in physical contact. A grounding conductor may be added to self-protective cable 70, either inside the electrically insulating jacket 47, or external thereto, as exemplified hereinabove.

The self-protected single-phase cables of the present invention may be utilized in myriad of different applications wherein immunity to magnetic field related interferences is an important factor. For example, it was found that the self-protected cable designs of the present invention may be advantageously used to manufacture self-protected communication cables, particularly for operating in the 0 Hz to 30 KHz frequency range. It was found that such self-protected communication cables have significantly improved immunity to magnetic interferences and improved signal to noise ratios, and are also more cost effective (about 15% to 30% reduction in manufacture costs) in comparison to conventional communication cables (e.g., data communication shielded cables). These properties are particularly beneficial for medical devices wherein induced magnetic interferences may endanger patients' lives, and in data communication applications requiring high signal to noise ratios (e.g., high frequency data communication).

As another non limiting example, it was found that the single-phase self-protective cables of the present invention may be advantageously used as audio cables (e.g., operating in the 0 Hz to 30 KHz frequency range). Due to the small self-induction of the cables and their immunity to external magnetic field interferences the sound quality obtained with the self-protected cables was substantially improved resulting in a much cleaner sound (as shown in the FIG. 15). In such audio cable implementations the quality of the audio signals may be further improved by using suitable electrically insulating covers 57 for the sub-conductors (e.g., Cross-linked polyethylene—XLPE) that assure substantially low capacitance values between the sub-conductors of the cable. The use of such low capacitance assuring electrically insulating covers in combination with the arrangement of the sub-conductors in the magnetic field attenuating structures of the present invention provides cables having substantially low and constant capacitance and inductance. This properties of the cable are ideal for audio cables as they guarantee good transfer of low-frequencies signals (i.e., due to the low capacitance), while also guaranteeing good transfer of high frequency signals (i.e., due to the low inductance) substantially without distortions and delays.

Figure 14:
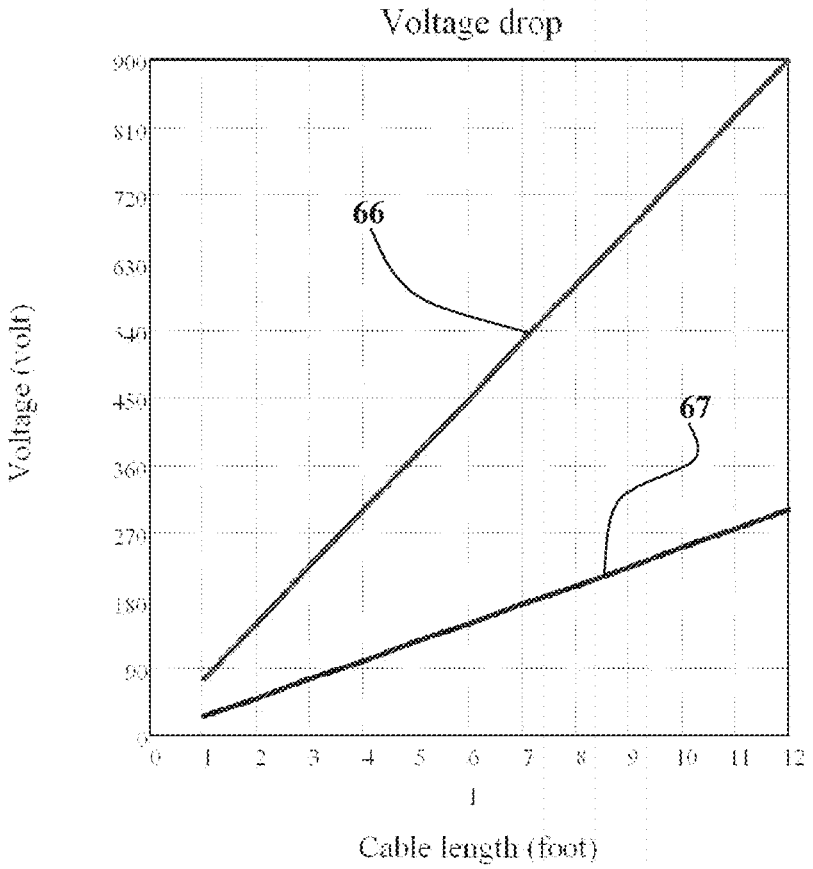
FIG. 14 is a plot of sound pressure level measurements conducted during a test of audio cables fabricated according to cable embodiment shown in FIG. 3E.

It was also found that the self-protective cables of the present invention have extremely accurate pulse delivery properties. The substantial improvement in the pulse delivery properties of the cables is mainly obtained due to the reduction in the electric AC resistance of the cables (i.e., due to the reduced self-inductance), and in some embodiments even reduction in the electrical DC resistance of the cables is also achieved, compared to equivalent cables of similar ampacity standard. In particular, the substantial reduction in the self-inductance of the cables results in a low back electromotive force (EMF) voltage during pulse transmission and during surge (voltage spikes), which permits use of smaller surge protectors with the self-protected cables, facilitate the pulse-shape control, and practical choice of cable lengths regardless of pulse shaping considerations. FIG. 14 shows typical voltage drop values of conventional 6 AWG cable (66) vs. 6 AWG EAPD cable (67) during transfer of a 10 KA/20 μS pulse in the cables.

Figure 8:
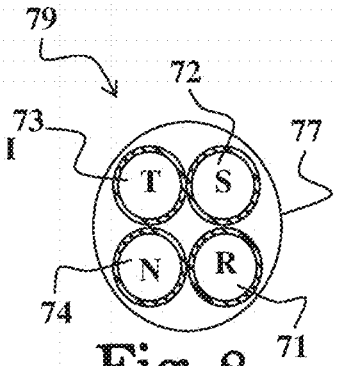
Fig. 8 (prior art)
FIG. 8 shows a cross-sectional view of a conventional three-phase cable.

The principles of the present invention may be also used to construct self-protective three-phase cables having improved attenuation factors, as will now be described with reference to FIGS. 8 to 13. A cross-sectional view of a conventional three-phase single-circuit cable design 79 is shown in FIG. 8. As seen, the phase conductors "R" (71), "S" (72), "T" (73) and the neutral "N" conductor (74) are typically enclosed together inside an electrically insulating jacket 77, where the phase conductors 71, 72 and 73, are designed to carry more or less same magnitude of AC electric current I.

Figure 9:
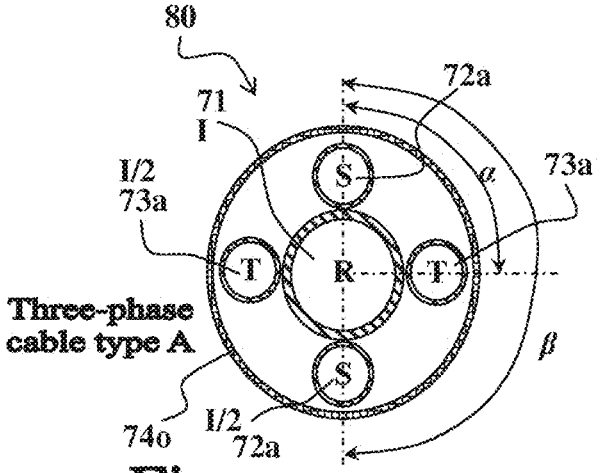
FIG. 9 shows a cross-sectional view of a three-phase single-circuit cable according to some possible embodiments of the present disclosure (three-phase cable of type A)

FIG. 9 illustrates a self-protective three-phase cable 80 according to some possible embodiments of the present application (three-phase cable of type A). In this embodiment the "S" (72) and "T" (73) phase conductors of the conventional three-phase cable design shown in FIG. 8 are each split into pairs of sub-conductors, 72*a* and 73*a* respectively, of smaller cross-sectional areas and which are circularly arranged about the "R" phase conductor 71, wherein the sub-conductors of each pair are electrically connected to each other in parallel. The cross-sectional areas of the sub-conductors in each of the pairs of the sub-conductors 72*a* and 73*a* are more or less the same so that an electric current of about I/2 is carried by each of these sub-conductors, and the cross-sectional area of the "R" conductor 71 remains substantially the same as in the conventional three-phase cable design 79 shown in FIG. 8.

In this circular arrangement the "S" and "T" sub-conductors of each of the pairs 72*a* and 73*a* are positioned on opposing sides of, and alongside, the "R" phase conductor 71, thereby forming a cross-like shape such that each phase sub-conductor is positioned on a circumference of a circle between two other sub-conductors carrying a different electrical phase and located on the circumference of the circle. Optionally, the angle (α) between adjacent sub-conductors is about 90°, and the angle (β) between adjacent sub-conductors carrying the same phase is about 180°. This structure provides for substantial cancelation of the magnetic fields applied over the cable 80. In order to further improve the attenuation factor of the self-protective cable 80 the neutral "N" conductor 74*o* may be shaped in a form of a hollow tube enclosing all other phase conductors and sub-conductors of the self-protective cable 80. Self-protective three-phase cable 80 may comprise an electrically insulating jacket (not shown), configured to enclose all (active and neutral) conductors and sub-conductors of the cable 80.

Figure 10A:
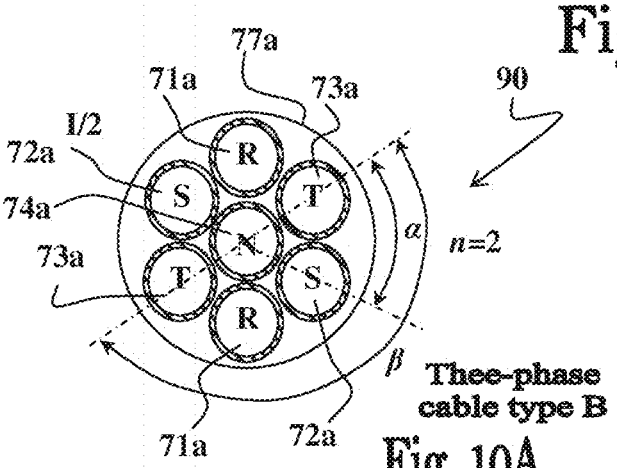
FIGS. 10A and 10B show a cross-sectional view of a three-phase double-circuit (n=2) cable according to some possible embodiments of the present disclosure (three-phase cable of type B)

FIG. 10A illustrates another possible embodiment of a three-phase self-protective cable 90 of the present application (three-phase cable of type B), wherein each phase conductor of the conventional three-phase cable design 79 shown in FIG. 8 is split into two sub-conductors (n=2) electrically connected in parallel to each other (e.g., the ends of the two "R" sub-conductors 71*a* are connected to each other at the extremities of the cable 90, and similarly the two "S" sub-conductors 72*a* and the two "T" sub-conductors 73*a*). The cross sectional area of each sub-conductor may be smaller than the cross-sectional area of the phase conductor in the conventional three-phase cable design 79 shown in FIG. 8. Optionally, the cross-sectional area of the sub-conductors is about half of the cross-sectional area of the phase conductors in the conventional three-phase cable design 79 shown in FIG. 8, such that the magnitude of the electrical current passing through them is about half of the magnitude of the electrical current passing through the phase conductors in the conventional cable design 79.

Figure 10B:
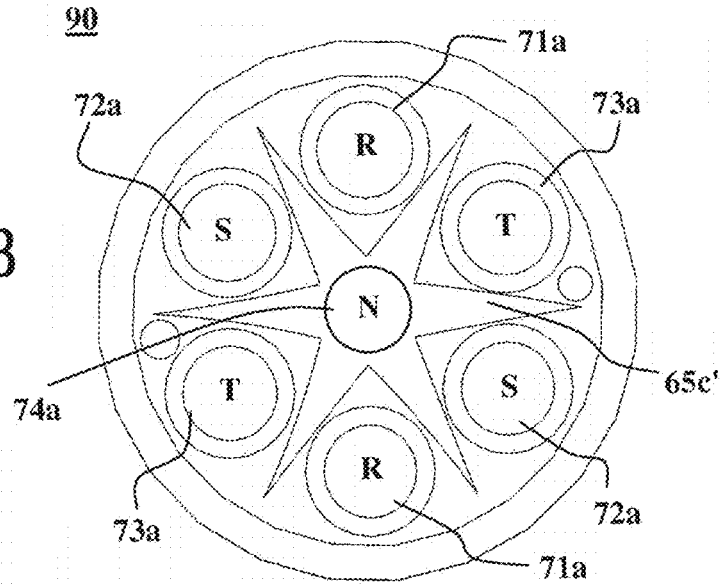

FIG. 10B exemplified a possible embodiment of the three-phase self-protective cable 90, as shown in FIG. 10A, in which the neutral conductor 74*a* is embedded inside an elongated asterix-shaped supporting element 65*c*'. As seen, the grounding conductor 74*a* is situated inside the center of the asterix shape of the supporting element 65*c*' and passes along its length. The supporting element 65*c*' may thus serve for electrically insulating the neutral conductor 74*a*, which therefore may not require further electrically coating. In a similar fashion a six-apex star-shaped supporting element 65*s* may be used, as in FIG. 5G.

In this example, the sub-conductors 71*a*, 72*a* and 73*a*, are arranged on a circumference of a circle in an intervening fashion within the electrically insulating jacket 77*a* of the self-protective cable 90. The sub-conductors 71*a*, 72*a* and 73*a*, are arranged such that each electrical phase sub-conductor is positioned circumferentially between and alongside two neighboring sub-conductors each carrying a different electrical phase. Optionally, the angle (α) between adjacent sub-conductors is about 60°, and the angle (β) between adjacent sub-conductors carrying the same phase is about 180°. The neutral ("N") conductor 74*a* may be positioned at the center of the circular arrangement of the self-protective cable 90. The attenuation factor of the self-protective cable 90 may be improved by tightly arranging the phase sub-conductors 71*a*, 72*a* and 73*a*, as close as possible to each other inside the electrically insulating jacket 77*a*, optionally such that their electrically insulating coatings are in contact (e.g., by using for the sub-conductors 71*a*, 72*a* and 73*a* and the neutral conductor 74*a* electrical wires having the same diameter).

Figure 11:
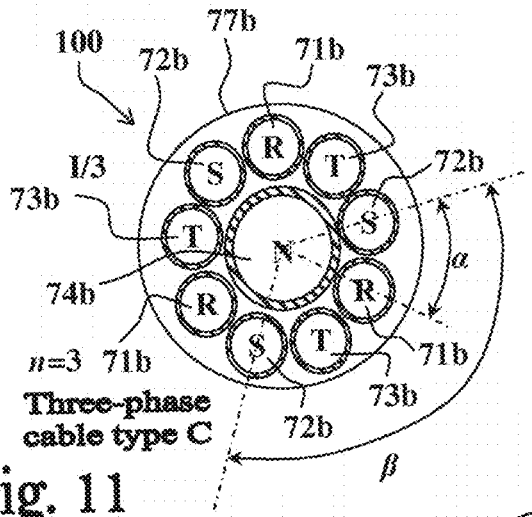
FIG. 11 shows a cross-sectional view of a three-phase triple-circuit (n=3) cable according to some possible embodiments of the present disclosure (three-phase cable of type C)

FIG. 11 demonstrates another three-phrase self-protective cable 100 (three-phase cable of type C) of the present application, wherein each phase conductor of the conventional three-phase cable design 79 is split into three (n=3) sub-conductors 71*b*, 72*b* and 73*b*, which are electrically connected to each other in parallel (e.g., the end of the three "T" sub-conductors 73*b* are connected to each other at the extremities of the cable 100, and similarly connecting the ends of the three "R" and "S" sub-conductors, 71*b* and 72*b*) and arranged on a circumference of a circle in an intervening fashion. More particularly, the phase sub-conductors are arranged inside the electrically insulating jacket 77*b* such that each sub-conductor is positioned circumferentially between and alongside two neighboring sub-conductors of another electrical phase. Optionally, the angle (α) between adjacent sub-conductors is about 40°, and the angle (β) between adjacent sub-conductors carrying the same phase is about 120°.

The cross sectional area of each sub-conductor may be smaller than the cross-sectional area of the phase conductor in the conventional cable design 79 shown in FIG. 8. Optionally, the cross-sectional area of the sub-conductors 71*b*, 72*b* and 73*b*, is about a third of the cross-sectional area of the phase conductors in the conventional cable design 79 shown in FIG. 8, such that the magnitude of the electrical current passing through them is about a third (I/3) of the magnitude of the electrical current passing through the phase conductors in the conventional three-phase cable design 79. The neutral ("N") conductor 74*b* may be placed at the center of this circular arrangement. The attenuation factor of the self-protective cable 100 may be further improved by tightly arranging the phase sub-conductors 71*b*, 72*b* and 73*b*, as close as possible to each other inside the electrically insulating jacket 77*b*, optionally, such that their electrically insulating coatings are in contact.

Optionally, the cross-sectional area of the neutral ("N") conductor 74*b* may be adjusted according to the diameter of the circular arrangement of the phase conductors such that the electrically insulating coatings of the phase sub-conductors 71*b*, 72*b* and 73*b*, contact the electrically insulating coating of the neutral ("N") conductor 74*b*.

Figure 12:
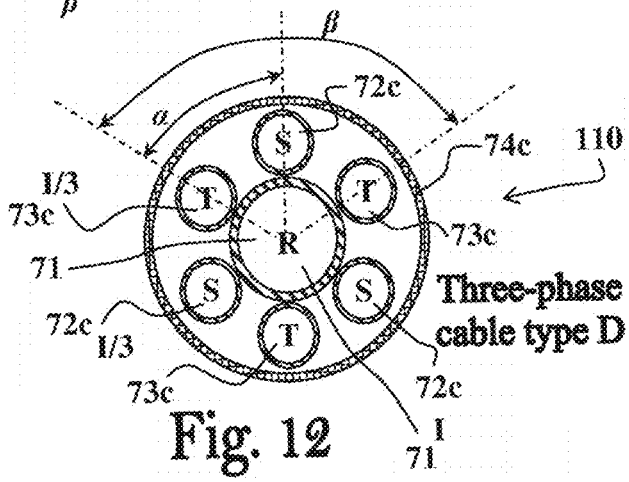
FIG. 12 shows a cross-sectional view of another three-phase triple-circuit cable of the present disclosure (three-phase cable type D)

FIG. 12 schematically illustrates yet another possible embodiment of a three-phase self-protective cable 110 of the present application (three-phase cable of type D), wherein only two of the phase conductors (e.g., "S" and "T") of the conventional three-phase cable design 79 are each split into three (triplicate) sub-conductors, 72*c* and 73*c*. The phase sub-conductors of each triplicate (72*c* or 73*c*) are electrically connected to each other in parallel (e.g., the ends of the three "T" sub-conductors 73*c* are connected to each other at the extremities of the cable 110, and so the ends of the three "S" sub-conductors 72*c*) and arranged on a circumference of a circle in an intervening fashion around the third phase conductor ("R") 71. More particularly, in the circular arrangement of phase sub-conductors in the three-phase self-protective cable 110 each sub-conductor is positioned between two other neighboring sub-conductors carrying another electrical phase, and that are positioned on the circle circumference. Optionally, the angle (α) between neighboring sub-conductors is about 60°, and the angle (β) between adjacent sub-conductors carrying the same phase is about 120°.

The neutral conductor 74*c* may be configured as a tube enclosing all other conductors and sub-conductors of cable 110, thereby increasing the attenuation factor of the cable 110. Self-protective three-phase cable 80 may comprise an electrically insulating jacket (not shown), configured to enclose all (active and neutral) conductors and sub-conductors of the self-protective cable 80.

The cross sectional area of each sub-conductor 72*c* and 73*c* may be smaller than the cross-sectional area of the phase conductor in the conventional three-phase cable design 79 shown in FIG. 8. Optionally, the cross-sectional area of the sub-conductors 72*c* and 73*c* is about a third of the cross-sectional area of the phase conductors in the conventional three-phase cable design 79 shown in FIG. 8, such that the magnitude of the electrical current passing through them is about third (I/3) of the magnitude of the electrical current passing through the phase conductors in the conventional three-phase cable design 79. The attenuation factor of the self-protective cable 110 may be further improved by tightly arranging the phase sub-conductors 72*c* and 73*c* as close as possible to each other, optionally, such that their electrically insulating coatings are in contact. In some possible embodiments the phase sub-conductors 72*c* and 73*c* are arranged around the third phase conductor 71 such that their electrically insulating coatings are in contact with the electrically insulating coating of the third phase conductor 71 at the center of this circular arrangement.

Figure 13:
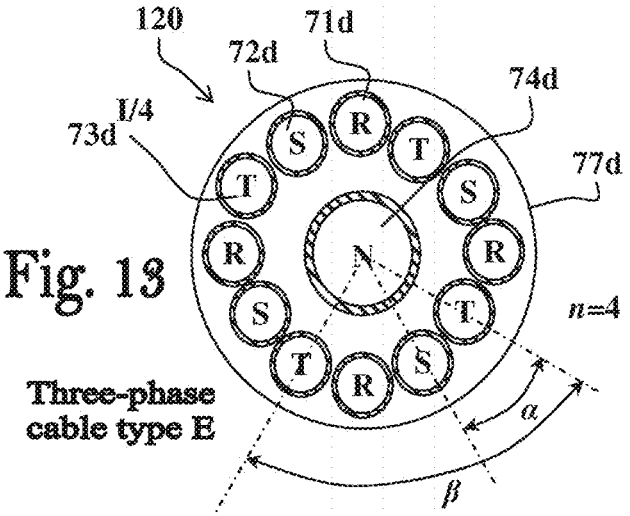
FIG. 13 shows a cross-sectional view of a three-phase quad-circuit (n=4) cable according to some possible embodiments of the present disclosure (three-phase cable of type E)

FIG. 13 demonstrates a three-phrase self-protective cable 120 (three-phase cable of type E) of the present application, wherein each phase conductor of the conventional three-phase cable design 79 is split into four (n=4) sub-conductors 71*d*, 72*d* and 73*d*, which are electrically connected to each other in parallel (e.g., the ends of the four "T" sub-conductors 73*d* are connected to each other at the extremities of the cable 120, and similarly the ends of the four "R" and "S", sub-conductors 71*d* and 72*d*) and arranged on a circumference of a circle in an intervening fashion. More particularly, the phase sub-conductors are arranged inside the electrically insulating jacket 77*d* such that each sub-conductor is positioned circumferentially between and alongside two neighboring sub-conductors carrying another electrical phase. Optionally, the angle (α) between neighboring sub-conductors is about 30°, and the angle (β) between adjacent sub-conductors carrying the same phase is about 90°.

The cross sectional area of each sub-conductor may be smaller than the cross-sectional area of the phase conductor in the conventional three-phase cable design 79 shown in FIG. 8. Optionally, the cross-sectional area of the sub-conductors 71*d*, 72*d* and 73*d*, is about a quarter of the cross-sectional area of the phase conductors in the conventional cable design 79 shown in FIG. 8, such that the magnitude of the electrical current passing through them is about a quarter (I/4) of the magnitude of the electrical current passing through the phase conductors in the conventional three-phase cable design 79. The neutral ("N") conductor 74*d* may be positioned at the center of this circular arrangement. The attenuation factor of the self-protective cable 120 may be improved by tightly arranging the phase sub-conductors 71*d*, 72*d* and 73*d*, as close as possible to each other inside the electrically insulating jacket 77*d*, optionally, such that their electrically insulating coatings are in physical contact.

Optionally, the cross-sectional area of the neutral ("N") conductor 74*d* may be adjusted according to the diameter of the circular arrangement of the phase conductors such that the electrically insulating coatings of the phase sub-conductors 71*d*, 72*d* and 73*d*, are in contact with the electrically insulating coating of the neutral ("N") conductor 74*d*. As will be exemplified hereinbelow, the various self-protected cables of the present application have improved attenuation factors and therefore they are substantially immune to interferences caused by electrical and magnetic fields. This immunity to electrical and magnetic interferences of the self-protective cables of the present application is attributed to the fact that the mutual inductance of these self-protective cables is significantly minimized and therefore the cable is less sensitive to external magnetic fields. Also, reduced self-inductance of the self-protective cable of the present application leads to a decreased voltage drop along the conductors/sub-conductors of the self-protective cables hereof, and thus to somewhat greater power transfer ability of these cables.

It is noted that the various three-phase cable examples shown in FIGS. 10, 11 and 13 may also utilize a central supporting element, as demonstrated in FIGS. 3D-3F and 5E-5G, by removing the neutral conductor "N" from the center of the cable and placing it alongside the sub-conductors or external to the cable.

The substantial reduction in the self-inductance of the cables provides that the electrical impedance (i.e., resistance) of the self-protective cables is also substantially reduced, which thereby improves the signal transfer properties of the cable. The substantially reduced self-inductance of the self-protected cables of the present invention may be employed in protection against electromagnetic pulse (EMP) attacks. In particular, the special arrangements of the sub-conductors and their electrical connectivity in the cable render the self-protected cables of the present invention immune to such EMP attacks, and this technology may be thus utilized to develop systems that can survive EMP attacks. Accordingly, the simplicity and use of relatively inexpensive elements in the embodiments of the present invention may be advantageously employed in the development of cost effective solutions to EMP threats.

It is noted that the attenuation factor obtained with the self-protective cable arrangement of the present application may be maximized by placing the sub-conductors as close as possible to each other while maintaining their intervening arrangement, optionally such that their electrically insulating coatings are in contact. In this way, the cross sectional area of the self-protective cables may be minimized and smaller amounts of electrically insulating jacket material is needed.

In order to get good performance out of the self-protective cables a precise symmetry in the conductors' layout is desired. The more accurate the layout is the better the performance that will be obtained. In addition, the closer the conductors/sub-conductors are to each other a better attenuation factor is obtained. Therefore, it is recommended to design the active conductors/sub-conductors to be laid against each other and have the ground conductor, which is passive and has no contribution to the performance, extruded beside the active conductors/sub-conductors.

If necessary, the magnetic field attenuation factor of the self-protected cables can be considerably increased by splitting the connectors into a greater number of sub-conductors.

Some Properties for Comparison

The induction EMF (electromotive force) is typically expressed by Faraday Maxwell law, as follows:

$$e = -\frac{d\Phi}{dt}[\mathrm{V}]; \tag{1}$$

where:

Φ—is the magnetic flux, Φ=B·S;

The induced electric voltage can be therefore calculated as follows:

$$E \cong KN \cdot B \cdot S \cdot w\ [\mathrm{V}], \tag{2}$$

where w=2πf, f=50 Hz;

N=3—is the number of coil winding;

$S=\pi r^2 \cong 21.64\ [\mathrm{cm}^2]$—the internal coil surface;

B—is the magnetic flux density [Gs];

K—is the turn shape factor which determines the interference voltage reduction—K<1.

Table 1 compares measurements of magnetic flux density generated around a conventional single-phase two-core electric cable and a self-protective cable of FIG. 7, both designed for electrical current of 30 A, voltage of 230V and frequency 50 Hz:

TABLE 1

| Distance from the cable center | Conventional cable | Cable of FIG. 7 |
|---|---|---|
| 20 cm | 24 mGs | $9.0 \cdot 10^{-6}$ mGs |
| 1.0 m | 0.24 mGs | $2.9 \cdot 10^{-9}$ mGs |

Table 2 compares measurements of magnetic fields induced around a conventional three-phase four-core cable (79 in FIG. 8) having a neutral conductor ("N") and a self-protective cable of FIG. 13 designed for electrical currents of about 240 A, voltage of 400V and frequency 50 Hz:

TABLE 2

| Distance from the cable center | Conventional cable | cable of FIG. 13 |
|---|---|---|
| 20 cm | 348.7 mGs | 1.2 mGs |
| 1.0 m | 13.7 mGs | $4.8 \cdot 10^{-4}$ mGs |

Table 3 presents self-inductances ratios of the conventional electrical cable ($L_{conv}$) in comparison with the self-protective cables of the present invention ($L_{self\text{-}prot}$) shown on FIG. 6A (single phase) and FIG. 13 (three-phase cable):

TABLE 3

| | single phase cable | three-phase cable |
|---|---|---|
| $L_{self\text{-}prot.}/L_{conv.}$ | 0.202 | 0.257 |

The results presented in table 3 show that the inductance of the self-protective cables of the present invention can be considerably lower than that of conventional coaxial cable designs.

Table 4 presents ratios between mutual inductances of the self-protective cables ($M_{self\text{-}prot}$) of the present invention shown in FIG. 6A (single phase) and FIG. 13 (three-phase cable) and that of conventional (FIGS. 1 and 8) cables ($M_{conv}$):

TABLE 4

| | single phase cable | three-phase cable |
|---|---|---|
| $M_{self\text{-}prot.}/M_{conv.}$ | 0.0054 | 0.04 |

Additional Production Costs of Cables and Wires

As will be appreciated the structures of the self-protective cables of the present invention are relatively simple, and accordingly, the production processes of these cables may be based on the commonly used cables manufacture techniques, such that their production costs may be only slightly higher than, or same as, the manufacture costs of equivalent conventional cable designs (e.g., 10 and 79 in FIGS. 1 and 8, respectively).

As will be discussed in the following examples, results obtained in various experiments and tests carried out with the self-protective cables of the present invention indicate a clear advantage of these inventive cables over their conventional counterparts.

Example 1—Single Phase Cables

An experiment exemplifying the immunity of the self-protective cables of the present invention to interferences induced by external magnetic field is described below.

A closed toroidal-core transformer (model HBL-105, PRI: 230 V—50 Hz (RED-RED) sec. 12 V—8.7 A (BLK. BLK.) 105 VA) was used as a source of an external magnetic field (i.e., the electromagnetic interference). As a result of the electrical current passing in the wires of the toroidal transformer a magnetic field of about 70-100 mGs had been produced adjacent to the round toroidal opening. Three interconnected open-circuit copper turns, each having a diameter of about 155 mm where drawn through the toroidal opening for each of the following cables prepared in advance:

1. A conventional single-phase cable with two copper cores each having a thickness—of about 5 mm.
2. The single-phase cable 30 of FIG. 2 having three insulated copper cores, with two side cores interconnected at their ends.
3. The single-phase cable 20 of FIG. 3A having four insulated copper cores with crosswise core interconnected at their ends.
4. The single-phase cable 60*c* of FIG. 6A with 8 insulated copper cores located circumferentially with the alternating cores interconnected at their ends.

The thickness of the cross-sectional areas of the "P" and "N" sub-conductors in the tested single-phase cables in 2) to 3) above being more or less equals to the 5 mm thickness of the conventional single-phase cable in 1) above. The voltage (voltage of interference) induced in each of this cables was measured across the two open ends from each side of each cable. The measured results are presented in Table 5.

TABLE 5

| magnitudes of induced voltage of interference | | |
|---|---|---|
| Cable type | Voltage of interference [V] | Attenuation factor |
| Conventional cable with 2 cores | 0.5 ÷ 0.6 | |
| Cable with 3 cores (FIG. 2) | 0.16 ÷ 0.2 | 2.5 ÷ 3.75 |
| Cable with 4 cores (FIG. 3A) | 0.2 ÷ 0.3 | 1.67 ÷ 3.0 |
| Cable with 8 cores (FIG. 6A) | 0.005 | 100 ÷ 120 |

As seen from Table 5 the interferences induced in the self-protected cables embodiments of the present invention were significantly lower than those induced in the conventional cable, and it is nearly proportional to the attenuation factor measured for external magnetic fields produced due to electrical current passed in the self-protective cables (See Table 6 below).

The attenuation factor of the self external magnetic field in the vicinity of different self-protective cables embodiments of the present application shown in FIG. 2, FIG. 4, FIG. 5A and FIG. 7, in comparison with that of a conventional cable are presented in Table 6.

TABLE 6

| Distance from | Magnetic flux density attenuation | | | |
|---|---|---|---|---|
| the cable [m] | Cable type A | Cable type B | Cable type C | Cable type D |
| 0.1 | 25 | $1.7 \cdot 10^3$ | $2.5 \cdot 10^3$ | $8.3 \cdot 10^4$ |
| 0.2 | 50 | $6.7 \cdot 10^3$ | $1.0 \cdot 10^4$ | $6.7 \cdot 10^5$ |
| 0.4 | 100 | $2.7 \cdot 10^4$ | $4.0 \cdot 10^4$ | $5.4 \cdot 10^6$ |

TABLE 6-continued

| Distance from | Magnetic flux density attenuation | | | |
|---|---|---|---|---|
| the cable [m] | Cable type A | Cable type B | Cable type C | Cable type D |
| 0.6 | 152 | $6.1 \cdot 10^4$ | $9.0 \cdot 10^4$ | $1.8 \cdot 10^7$ |
| 1.0 | 250 | $1.7 \cdot 10^5$ | $2.5 \cdot 10^5$ | $8.3 \cdot 10^7$ |
| 1.4 | 343 | $3.2 \cdot 10^5$ | $4.8 \cdot 10^5$ | $2.2 \cdot 10^8$ |
| 2.0 | 488 | $6.7 \cdot 10^5$ | $9.9 \cdot 10^5$ | $6.7 \cdot 10^8$ |

It is seen that attenuation factors of the self external magnetic fields (i.e., that are produced by the cables) are in correlation with the induced voltages of interference, as expected.

Example 2—Three Phase Cables

Attenuation factor of the self external magnetic field for various self-protective three-phase cables embodiments of the present application shown in FIG. 9, FIG. 10, FIG. 11, FIG. 12, and FIG. 13 in comparison with conventional three-phase cable designs (e.g., 79 in FIG. 8) are presented in Table 7.

TABLE 7

| Distance | Magnetic flux density attenuation | | | | |
|---|---|---|---|---|---|
| from the cable [m] | Cable type A | Cable type B | Cable type C | Cable type D | Cable type E |
| 0.1 | 5.3 | 5.5 | 13.9 | 35.0 | 37.4 |
| 0.2 | 10.4 | 10.7 | 50.5 | 135.7 | 289.9 |
| 0.4 | 20.5 | 21.1 | 156.6 | 537.2 | $22.8 \cdot 10$ |
| 0.6 | 30.7 | 31.5 | 255.3 | $11.9 \cdot 10^2$ | $75.7 \cdot 10^2$ |
| 1.0 | 50.9 | 52.4 | 369.9 | $32.1 \cdot 10^2$ | $28.2 \cdot 10^3$ |
| 1.4 | 71.2 | 73.2 | 414.8 | $61.0 \cdot 10^2$ | $49.8 \cdot 10^3$ |
| 2.0 | 101.6 | 104.6 | 447.8 | $11.7 \cdot 10^3$ | |

As seen, the attenuation factors of the self external magnetic field (i.e., magnetic field produced by the cables) are in correlation with attenuation factors to externally induced voltage of interference (Table 5).

Example 3

In this example the same setup as in example 1 was used using prepared self-protective cables designs shown in FIGS. 1, 2, 4, 5A, 6A and 7-13. The magnetic field produced by the cables was computed (using EPRI TLWorkstation™) at two points: one being remote by 50 cm, and the other by 2 m from the center of the cable.

Table 8 presents attenuation factors measured with various embodiments of the present invention.

TABLE 8

| Fig. # | Type | Magnetic flux density [mGs] | Attenuation factor for magnetic flux density | Attenuation factor for the voltage of interference |
|---|---|---|---|---|
| 1 | conventional single-phase | 0.96<br>$6.0 \cdot 10^{-2}$<br>(Current 30 A) | ~ | ~ |
| 2 | single-phase type A | $7.6 \cdot 10^{-3}$<br>$1.2 \cdot 10^{-4}$ | 126<br>490 | 0.16 ÷ 0.2 |
| 4 | single-phase type B | $2.29 \cdot 10^{-5}$<br>$9.0 \cdot 10^{-8}$ | 42000<br>667000 | |
| 5A | single-phase type C | $1.5 \cdot 10^{-5}$<br>$6.1 \cdot 10^{-8}$ | ~63400<br>~985000 | |

TABLE 8-continued

| Fig. # | Type | Magnetic flux density [mGs] | Attenuation factor for magnetic flux density | Attenuation factor for the voltage of interference |
|---|---|---|---|---|
| 6A | single-phase | | $\sim 65 \cdot 10^6$ | 100-120 |
| | type C* | | $\sim 41.67 \cdot 10^8$ | |
| 7 | single-phase | | $\sim 1.05 \cdot 10^7$ | |
| | type D | | $\sim 6.67 \cdot 10^8$ | |
| 8 | conventional | 55 | | |
| | three-phase | 3.4 (Current 240 A) | | |
| 9 | three-phase | 2.1 | 26 | |
| | type A | 0.03 | 102 | |
| 10 | three-phase | 1.96 | 28 | |
| | type B | 0.033 | 104 | |
| 11 | three-phase | 0.26 | 209 | |
| | type C | $0.759 \cdot 10^{-2}$ | 448 | |
| 12 | three-phase | 0.066 | 830 | |
| | type D | $0.257 \cdot 10^{-3}$ | 13200 | |
| 13 | three-phase | $0.565 \cdot 10^{-4}$ | 4600 | |
| | type E | $1.06 \cdot 10^{-7}$ | 71600 | |

Example 4

Economical Aspects of the Use of the Invented Cables

Normally the existence of external magnetic field for cables with very low currents and high frequencies range may be negligible, hence the an important feature of the self-protected cables of the present application in this case is their low sensitivity to external magnetic fields generated by other installations, and consequently much lower risk of undesirable signals penetration to the network. This feature is of special importance for cables used to connect computers, sensitive electronic equipment, communication, monitoring and control systems to and inside the network. Further advantage of communication cables is much lower losses at high frequencies.

In addition the self-protective cables of the present invention can also provide economic advantages by saving in amounts of conductor material. The saving in conductor material will be demonstrated by comparing design considerations of a conventional three-phase cable 79 (as shown in FIG. 8) with those of a self-protective three-phase cable 90 (as shown in FIG. 10). In the self-protective three-phase cable 90 each phase conductor is divided into two sub-conductors (n=2) connected in parallel. If the current density in both designs is preserved, the amount of conducting material would also be preserved. As it is known, according to the standard requirements, the smaller is the conductor cross-section area the higher the electrical current density that is permitted to pass through it. The following comparison between the three-phase cables 79 and 90 is based on the manufacturer specifications for the low voltage underground cables (up to 1 kV) (Superior Cables Ltd. Power Cable Catalogue No. 833015027).

In this example the conventional (of catalogue number 833015027) three-phase cable 79 has three 240 $mm^2$ conductors and 120 $mm^2$ neutral (zero) conductor, and it is designed for maximal current of 3×465 A (20° C. in ground). The conventional three-phase cable 79 may be replaced by the self-protective cable 90 having six phase sub-conductors and one neutral conductor, wherein the cross-sectional area of the phase sub-conductors is 2×95=190 $mm^2$ and for the neutral conductor 95 $mm^2$. According to the table provided in Power Cable Catalogue No. 833015027 the maximal current (under similar conditions) for a 95 $mm^2$ conductor is 275 A, namely, permitted phase current will therefore be equal to 550 A, instead of the 465 A permitted in the conventional three-phase cable 79.

The total conductor material cross-section in the standard three-phase cable is 3×240+120=840 $mm^2$, whereas in the self-protective three-phase cable 7×95=665 $mm^2$. Accordingly, the amount of saved conductor material is $$\frac{840-665}{840} \times 100 \approx 20\%.$$

Further saving in the amounts of conducting material may be achieved by using sub-conductors having non-standard cross-sectional areas.

In addition, assuming the thickness of the electrical insulating coatings of the sub-conductors is as indicated in the table (of Catalogue No. 833015027, 1.6 mm instead of 2.2 mm) certain saving in the amount of internal electrically insulating material of the sub-conductors can be achieved due to certain reduction of the external diameter of the cable achieved by the reduction thickness of the electrical insulating coatings of the sub-conductors, as presented in the following table.

TABLE 9

| | External diameter ($d_{ext}$) | Amount of electrically insulating material |
|---|---|---|
| Conventional cable (79) | 72.42 mm | $S_{ins4} = S_{full} - S_{co4} = 4119.1 - (3 \times 240 + 120) = 3279.1\ mm^2$ |
| Self-protective cable (90) | 57 mm | $S_{ins7} = S_{full} - S_{co7} = 2551.76 - (7 \times 95) = 1886.76\ mm^2$ |

Evaluation of Resistances and Losses

Resistance of separate phase conductors at a temperature of 20° C. are given in the above mentioned Catalogue. For a standard three-phase cable 79 with conductors cross-sectional of 240 $mm^2$ there is a typical resistance of $R_4$=0.0754 Ω/km, and for the self-protective three-phase cable 90, $R_7$=0.0965 Ω/km. However, each phase conductor in the self-protective three-phase cable 90 is divided into n sub-conductors (n=2), optionally with equal cross-sectional areas. Therefore, the total cooling surface of such phase in comparison with phase conductor with cross-sectional area that equals to n×s (where s is the cross-sectional are of each sub-conductor) is increased by a factor of $\sqrt{n}$ with concurrent increase of equivalent heat resistance of the phase conductor by a factor of n.

In addition, heat radiation is also increased due to the decrease in the thickness of the electrically insulating coatings of the sub-conductors. Therefore, the temperature of such conductor should drop (below 20° C.), resulting in the resistance drop of $R=R_{20^\circ C.}[1+\alpha_{20^\circ C.}(\theta-20)]\sim 0.095$ Ω/km (where $\alpha_{20^\circ C.}=0.00393\ [K^{-1}]$).

Evaluation of the Energy Saving Due to Lower Eddy Currents Induced in the Earth by Magnetic Field Produced by the Cable Energy losses in the cable proximity (for example in earth) can be calculated according to the following formula:

$$P = \sqrt{\frac{\omega \cdot \mu_0}{2 \cdot \gamma}} \cdot H_{S.ef}^2 \left[\frac{W}{m^2}\right],$$

where $\omega=2\pi f=314.16$ [rad/sec] is the angular frequency at 50 Hz;

$\mu_0=4\pi\cdot10^{-7}$ [H/m] is the magnetic permeability of vacuum and earth;

$$\gamma = 0.01\left[\frac{1}{\text{Ohm}\times\text{m}}\right]$$

is the specific conductivity of the earth;

$$H_{S\cdot ef} = \frac{B_{S\cdot ef}}{4\cdot\pi}$$

is the earth surface projection of magnetic field intensity in [A/m], where $B_{S\cdot ef}$ is the projection of magnetic flux density of the earth surface in units of [mGs].

Assuming that inside a trench the distance from the center of the cable to the earth surface in 1.0 m. At a distance of 1.0 m from the cable center for electrical current of 465 A the magnetic flux density is equal to:

for conventional three-phase cable 79—26.45 mGs; and for the self-protective three-phase cable 90—0.505 mGs.

The attenuation factor at a distance of 1.0 m is equal to 52.4 (see Table 1). Using equation (1), the saving of energy which is typically wasted due to magnetic losses caused by attenuation of the external magnetic field on the trench surface may be computed by:

$$\Delta P = \sqrt{\frac{314.16\cdot4\pi\cdot10^{-7}}{2\cdot0.01}}\cdot(26.45-0.505)^2 \cong 0.6\left[\frac{\text{W}}{\text{m}^2}\right].$$

Assuming that the distance 1.0 m from the center of the cable to the earth surface remains unchanged along the circle perimeter with a radius of 1.0 m. Then the general loss saving at a distance of 1 km is: $\Delta P=3.77$ kW/km. The losses saving per a single phase is equal to 1257 kW/km, which is equivalent to the phase resistance reduction by a value of $$\Delta R = \frac{1.257}{465^2} = 0.00581\left[\frac{\text{Ohm}}{\text{km}}\right].$$

Hence, for the self-protective three-phase cable 90 the equivalent phase resistance is equal to: R7=0.0965−0.0058=0.0907 [Ω/km]. The total power transmitted over the cable is $-P=\sqrt{3}\cdot400\cdot465\cdot0.9\cdot10^{-3}=290$ [kW] (for cos $\varphi=0.9$). The phase resistance increase from 0.0754 [Ω/km] to 0.0907 [Ω/km] results in an increase of losses of 3308 [W], which is 1.1% of the transmitted power. The distance reduction from the center of the cable to the earth surface (less than 1.0 m) results in drastic increase of the $H_{S\cdot ef}^2$ value and increase of ΔP, and in additional drastic decrease of equivalent phase resistance of the self-protective three-phase cable 90. It is worth mentioning that normally energy transmission at voltage of 400V is at a distance much shorter than 1 km. Therefore the increase in losses can be neglected.

Table 10 presents results obtained for three-phase (copper) cables of types B and E compared to a standard three-phase cable for a electrical current of about 345 A.

TABLE 10

| Attenuation factor | | Magnetic flux density [mGs] | | | |
|---|---|---|---|---|---|
| Type E (12 × 35 + 70)* [mm²] | Type B (6 × 70 + 70)* [mm²] | Type E (12 × 35 + 70)* [mm²] | Type B (6 × 70 + 70) [mm²] | Standard cable (3 × 150 + 70)* [mm²] | Distance from the cable |
| 63.7 | 5.5 | 32.43 | 374.8 | 2067 | 0.1 |
| 335 | 10.7 | 1.496 | 46.83 | 501.3 | 0.2 |
| 2375 | 21.1 | $5.204\cdot10^{-2}$ | 5.854 | 123.6 | 0.4 |
| 4583 | 26.2 | $1.725\cdot10^{-2}$ | 3.019 | 79.06 | 0.5 |
| 7779 | 31.5 | $7.029\cdot10^{-3}$ | 1.735 | 54.68 | 0.6 |
| 17,937 | 41.9 | $1.711\cdot10^{-3}$ | $7.317\cdot10^{-1}$ | 30.69 | 0.8 |
| 33,254 | 52.4 | $5.9\cdot10^{-4}$ | $3.746\cdot10^{-1}$ | 19.62 | 1.0 |

*([total No. of sub-conductors] × [cross-sectional area of each sub-conductor] + [cross-sectional area of grounding sub-conductor])

Example 5

This experiment was designed to measure the attenuation of the self-protective cables of the present invention in the presence of an external magnetic field, as follows:

a. The external magnetic field (EMF) was produced by a Toroid Power Transformer connected to a 220 V source and the CUT (Cable Under Test) exposed to the EMF is passed through the opening of the toroid.
b. Three following configurations were tested:
   i) conventional two cores cable design (as in FIG. 1);
   ii) self-protective cable configuration with 3 cores FIG. 2, two of which are electrically connected in parallel (N=2);
   iii) self-protective cable configuration as in ii) but with 8 cores, each four are terminated together (N=4, as shown in FIG. 6A);
c. The induced voltage at the opened ended CUT was measured to evaluate the effect of external magnetic field. It is noted that the CUT should not be loaded in order to avoid effects of internal field due to load currents.
d. The objective was to compare relative results between the cables.

Measurement with a Conventional Cable:

A conventional two cores cable design was attached to the measurement device and the result measured complied with predicted computations. The voltmeter reading for a 70-100 milli-Gaus [mGs] field at the center of the Toroid Transformer field was 0.503[V].

Results

TABLE 11 presents the measured results

| Test No. | Cable Type | No. Of Cores (n) | "N" | Magnetic Flux [mG] | Induced Voltage of interference | New Level |
|---|---|---|---|---|---|---|
| 1 | Reg. | 2 | 1 | 70 ÷ 100 | 0.500 | 100% |
| 2 | Basic Config. | 3 | 2 | 70 ÷ 100 | 0.160 | 32% |
| 3 | Advanced Config | 8 | 4 | 70 ÷ 100 | 0.005 | 1% |

These results indicate that even the simple configuration (as shown in FIG. 2) presents 68% improvement. An advanced configuration presents 99% improvement.

Example 6

In this example two audio cables fabricated using the single-phase cable configuration exemplified in FIG. 3E were tested. The tested cables, each 4.5 m in length, were used to connect a power amplifier to speakers. The performance was tested using a sound pressure level (SPL) meter (ADC SLM-100) and a spectrum analyze of Yoshimata Electronics PC utility. The distance between the speakers and the SPL meter was about 400 mm. The SPL attenuation was about −70 db, and the spectrum analyzer baseline about −45 db.

Figure 15:
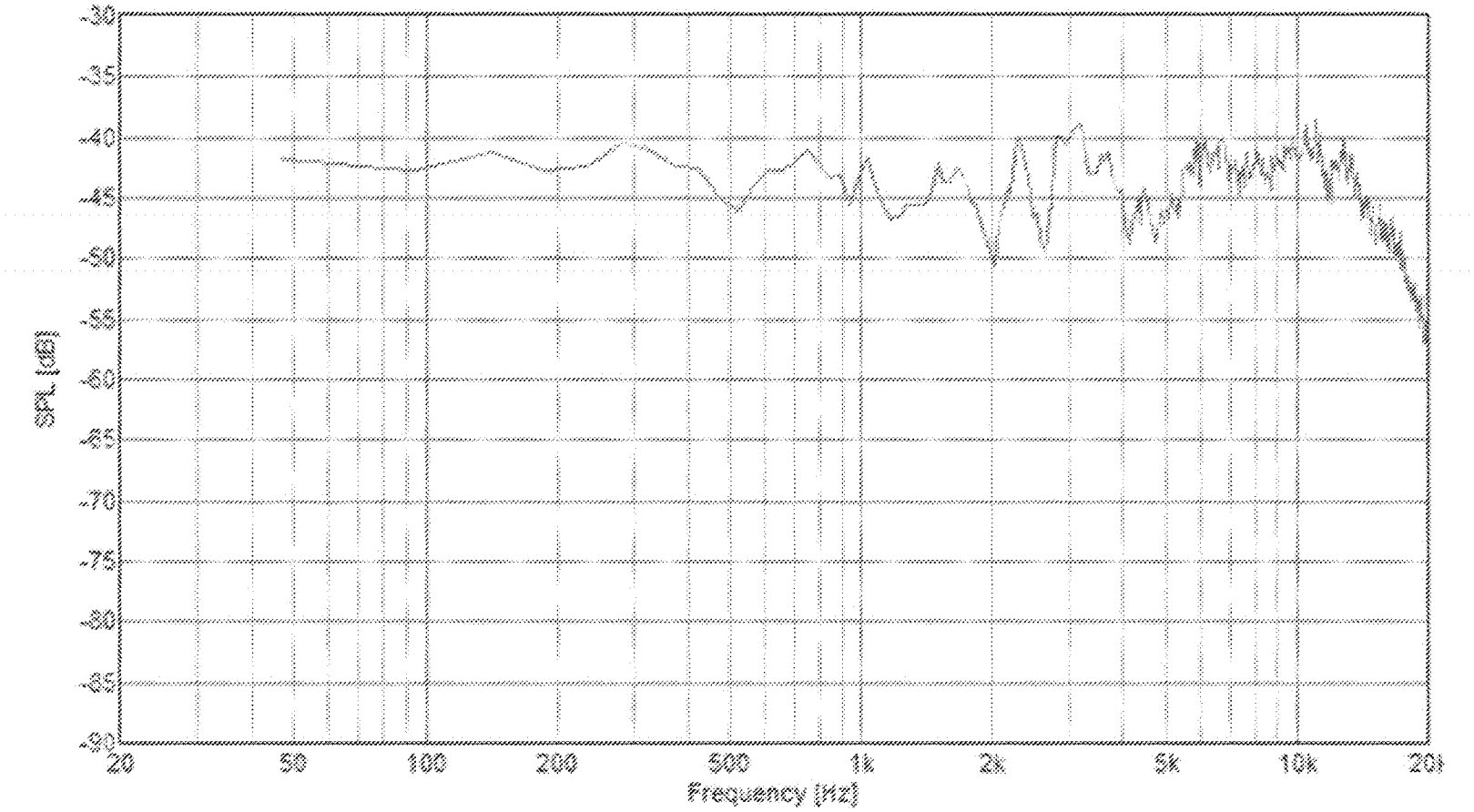
FIG. 15 is a plot showing performance of audio cables of the present application.

The measured results are shown in the plot of FIG. 15. As seen the audio cables of the present application provide significantly improved performance at frequencies below 125 Hz. In addition, the mid frequencies (between about 50 Hz to 20 KHz) are "flatter".

Example 7

In this non-limiting example the self-protected cables scheme was implemented for a single phase 2×35 $mm^2$ DC cable, designed to operate with electrical currents of about 160 A. The 2×35 $mm^2$ cable was replaced by a 4×16 $mm^2$ welding cables (combined cross section of 2×32 $mm^2$) i.e., each conductor of the original 2×35 $mm^2$ cable was replaced by two 16 $mm^2$ sub-conductors electrically connected to each other in parallel to implement the self-protective cable structure shown in FIG. 3A.

The self-protective cable implemented by the sub-conductors of combined crossed section of 2×32 $mm^2$ provides 9% saving in the electrically conducting material of the cable (copper) assuming that the overall voltage drop is within the design limits, which is considered as the most expensive component in the cable. In addition, the saving in copper represents a significant saving in the cable weight as the copper is by far the heaviest component of the cable. It is noted that cost and weight savings are very important in the automotive electric vehicle (EV) industry.

The self-protected cable exhibits the major expected benefits of immunity to external EM fields, reduced cable cross section which represent copper saving, reduced weight and costs, and improved heat dispersion. It should be therefore appreciated that the self-protected cables of the present invention alleviates the engineering design constraints in creating a compact solution, and enable design of lighter and cheaper cable structures.

Simulations of the self-protective cables exemplified hereinabove showed improvement in heat dispersion of the self-protective cables of about 10% to 25%, as compared to regular/standard cables. It is realized from these results that the self-protective cables of the present invention can be used to carry higher current capacities for nominal cable cross sectional areas, for reduction of cable cross sectional area for nominal current, which results in copper saving and reduced cable weight.

Figure 16:
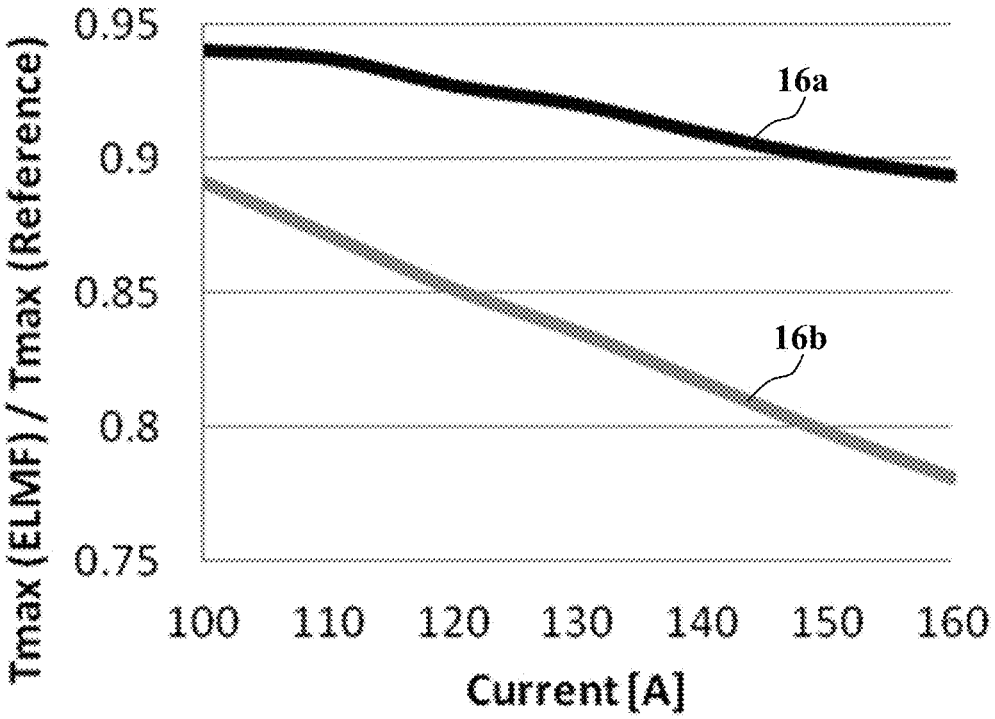
FIG. 16 shows graphical plots of simulated maximum temperatures within the self-protected cables according to possible embodiments relative to maximum temperatures developed in a reference standard cable.

The plots shown in FIG. 16 illustrate ratios of the maximum temperature developed within the cables, at an ambient temperature of 30°, as a function of electrical current. The plots in FIG. 16 respectively illustrate ratios between temperatures developed in a single phase 4×16 $mm^2$ self-protective cable (16*a*) and a single phase 2×35 $mm^2$ reference cable, and ratios between temperatures developed in a single phase 4×10 $mm^2$ self-protective cable (16*b*) and the single phase 2×35 $mm^2$ reference cable, for different electrical currents. As seen in FIG. 16, the use of sub-conductors of smaller cross-sectional areas in the self-protective cables improves their heat dissipation properties, and as the electrical current is increased the dissipation of heat by the self-protective cables is improved with greater rate for self-protective cables having smaller cross-sectional areas.

As seen, a single phase 4×10 $mm^2$ self-protected cable can be effectively used for carrying electrical current capacity conventionally used with a single phase 2×35 $mm^2$ reference standard cable.

Additional benefits of the self-protected cables include sustaining high electromagnetic pulse (EMP) rates, lower magnetic field in the vicinity of the cables from tens to thousands times less than those obtained conventional/standard cables, decreased reactive voltage drop along the lines resulting from a considerably reduced self-inductance, and higher flexibility (less shielding) in comparison to the standard cable configurations.

Importance of the self attenuation properties of the cable configurations of the present application is related to the fact that continuous exposure to magnetic fields may constitute a very serious hazard for human health. In addition, the emitted magnetic field may affect and disturb the operation of many sensitive devices, such as computers, communication systems, measurement devices, medical instrumentation etc. Furthermore, the property of the self-protective cables of the present invention to attenuate external magnetic fields strongly increases for larger distances from the cable and for non-symmetrical load of multiphase cables (i.e., when the phase electrical currents are not balanced). It was noticed that the three-phase cable designs of the present invention are capable of effectively reducing external magnetic fields produced in such non-symmetrical loads situations where the phase difference between the phase are smaller than 50%. This property of the self-protective cables results from the fact that it has much smaller mutual inductance and therefore these cables are significantly less sensitive to external magnetic fields.

It is appreciated that the self protective cables may be advantageously used in automotive electric-vehicles (EVs), e.g., within the EV, where high currents are flowing along the vehicle from the generation system to the batteries of the EV, and at parking and charging posts.

The self-protective cables of the present invention may be manufactured employing conventional electrical cables production techniques, as known in the cables industry. Accordingly, the conductors and sub-conductors may be manufactured from any suitable electrically conducting material, such as metals (e.g., copper or aluminum), for example in a form of braided/bundled wires. Similarly, the electrically insulating jackets/coatings used in the self-protective cables of the present invention may be manufactured from any suitable electrically insulating material, such as, but not limited to, PE, PVC or XLPE.

It should be mentioned that the amount of conductor material (e.g., metal, such as copper or aluminum) used in the self-protective cables of the present invention generally remains unchanged, or is even somewhat reduced, in comparison with conventional cable designs. This means that also the weight and size of the self-protective cables of the present invention substantially remains unchanged, or becomes reduced. While the outer electrically insulating coating/jacket used in the self-protective cables of the present invention for mechanical/electrical protection is generally the same as in the conventional cables counterparts, there is no need in the self-protective cables of the present invention for ferromagnetic coatings for magnetic field shielding, which results in reduced weight, size and cost.

The self-protective cables of the present invention may be used in a wide range of electric currents, ranging from microampers to thousands of amperes. Accordingly, these cables are suitable for use as power supply cables, communication cables (e.g., signal and control cables for computers and sensitive instrumentation systems), as cables for high and very high frequency devices, and for very high current connections in power and transformation stations.

The self-protective cables of the present invention are particularly useful for hospitals or industry measuring observation points, wherein the measuring instrument used is sensitive to interferences. These cables are also ideal for installations in living rooms of peoples who are extremely sensitive to radiation, and may also be suitable for under plaster in dry and damp places, as well in concrete and masonry (a direct laying in shaken or stamped concrete is excluded).

Other possible implementations of the self-protective cables of the present invention may include use in concrete conduits, in clay or concrete pipes and thermal insulation materials of buildings, light duty equipment, as connector cables for domestic appliances (e.g., kitchens cooking and heating apparatus, offices, household appliances in damp and wet areas such as refrigerators, washing machines, spin-driver etc.)

It is further noted that the reduced self-inductance of the self-protective cables of the present invention leads to a decrease in the voltage drop along the cables, and thus to higher power transfer ability.

The above examples and description have of course been provided only for the purpose of illustration, and are not intended to limit the invention in any way. As will be appreciated by the skilled person, the invention can be carried out in a great variety of ways, employing more than one technique from those described above, all without exceeding the scope of the invention.

The invention claimed is:

1. A three-phase electric cable structure arrangement having a nominal maximal permitted electric current density per conductor of a conventional three-phase cable original design, wherein said three-phase electric cable structure arrangement is configured to provide immunity to external magnetic interferences, reduced total conductors' cross sectional areas, and reduced cable weight, relative to said conventional three-phase cable original design, said electric cable structure arrangement comprises:

three sets of sub-conductors, each of said three sets of sub-conductors comprising two sub-conductors configured to carry electric current of a respective phase conductor of said three-phase conventional cable original design according to its nominal maximal permitted electric current density and provide to said electric cable structure arrangement an attenuation factor between 5.5 to 104.6 for an external magnetic field source at a distance between 0.1 to 2.0 m from said electric cable structure arrangement, respectively, the sub-conductors of each set being electrically connected to each other in parallel for carrying said electrical current associated with the respective phase being different from the electrical phase of the other sets of sub-conductors, the sub-conductors of said three sets are arranged in said electric cable structure arrangement in an intervening manner such that a sub-conductor of each one of said three sets of sub-conductors is placed adjacent and alongside at least two other sub-conductors of at least another one of said three sets of sub-conductors, and such that electric currents of each two neighboring sub-conductors of the different sets are of different electrical phases, the sum of the cross-sectional areas of the n sub-conductors in each one of the sets of sub-conductors is smaller than cross-sectional area of the respective phase conductor of said conventional cable original design, thereby reducing total amount of electrically conducting material and reducing external diameter and weight of the cable, with respect to said conventional three-phase cable original design, while having for said two sub-conductors having said smaller sum of cross-sectional areas the per conductor nominal maximal permitted electric current density.

2. The three-phase electric cable structure arrangement of claim 1 wherein the sub-conductors are arranged around a central supporting element configured and operable to hold and immobilize the sub-conductors, said central supporting element configured as either an elongated cylindrical element or an elongated multipoint star-shaped element.

3. The three-phase electric cable structure arrangement of claim 2 comprising either a grounding conductor or a neutral conductor placed inside the central supporting element and passing along its length.

4. The three-phase electric cable structure arrangement of claim 1 wherein the sub-conductors are arranged on a circumference of a circle, the three-phase electric cable structure arrangement comprising either a grounding conductor or a neutral conductor placed at a center of the circle.

5. The three-phase electric cable structure arrangement of claim 1 comprising either a grounding conductor or a neutral conductor placed beside and alongside the sub-conductors.

6. The three-phase electric cable structure arrangement of claim 1 comprising at least one neutral conductor shaped in form of a hollow tube enclosing all other conductors and/or sub-conductors of the three-phase electric cable structure arrangement.

7. The three-phase electric cable structure arrangement of claim 1, wherein the sub-conductors are arranged on a circumference of a circle, and wherein an angle between neighboring sub-conductors on the circumference is 60°, and an angle between adjacently located sub-conductors on the circumference carrying the same phase is 180°.

8. The three-phase electric cable structure arrangement of claim 1, comprising first and second sets of the sub-conductors associated with first and second phases of the cable respectively, and a conductor associated with a third phase of the electric cable structure arrangement, said sub-conductors are arranged on a circumference of a circle, and said conductor associated with said third phase is placed at a center of the circle, and wherein an angle between neighboring sub-conductors on the circumference is 90°, and an angle between adjacently located conductors carrying the same phase is 180°.

9. The three-phase electric cable structure arrangement of claim 1 wherein sub-conductors having greater cross-sectional areas are located closer to a geometric cross-sectional center of the three-phase electric cable structure arrangement, and sub-conductors having smaller cross-sectional areas are located closer to boundaries of a cross-section of the three-phase electric cable structure arrangement.

10. The three-phase electric cable structure arrangement of claim 1 wherein the reduction in the amount of electrically conducting material is by at least 20%.

11. A three-phase electric cable structure arrangement having a nominal maximal permitted electric current density defined per conductor of a three-phase cable design according to a manufacturer specifications, wherein said three-phase electric cable structure arrangement is configured to provide immunity to external magnetic interferences, reduced total conductors' cross sectional areas, and reduced cable weight, relative to said three-phase cable designed according to said manufacturer specifications, the three-phase electric cable structure arrangement comprises:

three sets of sub-conductors, each of said three sets of sub-conductors comprising a predetermined number n=2, 3 or 4, of the sub-conductors configured to carry electric current of a respective phase conductor of said three-phase conventional cable original design according to its nominal maximal permitted electric current density and provide an attenuation factor to said three-phase electric cable structure arrangement between 5.5 to 37.4 to an external magnetic field source located at a distance of 0.1 m from said electric cable structure arrangement, the sub-conductors of each set of sub-conductors being electrically connected to each other in parallel for carrying electrical current of one phase different from the electrical phase of the other sets of sub-conductors, the sub-conductors of said three sets of sub-conductors are compactly arranged inside the electric cable structure arrangement in an intervening manner such that a sub-conductor of each one of said three sets of sub-conductors is placed adjacent and alongside at least two other sub-conductors of at least another one of said three sets of sub-conductors, such that the electric currents in each two neighboring sub-conductors of the different sets are of different electrical phases, the cross-sectional area $a_{sub}$ of each sub-conductor of the n sub-conductors in each of said three sets of sub-conductors is smaller than a cross-sectional area $a_{cond}$ of a conductor in said three-phase cable design according to the manufacturer specifications, for the nominal maximal permitted electric current, divided by said predetermined number n of the sub-conductors, $a_{sub}<a_{cond}/n$, total amount of electrically conducting material in said three-phase electric cable structure arrangement having said smaller cross-sectional conductors areas is smaller than total amount of electrically conducting material in said three-phase cable design according to the manufacturer specifications for the nominal maximal permitted electric current, external diameter of said three-phase electric cable structure arrangement having said smaller conductors cross-sectional areas is smaller than external diameter of said three-phase cable design according to the manufacturer specifications for the nominal maximal permitted electric current, and weight of the three-phase electric cable structure arrangement having said smaller conductors cross-sectional areas is smaller than weight of said three-phase cable design according to the manufacturer specifications for the nominal maximal permitted electric current, while having its nominal maximal permitted electric current density.

12. A method of constructing the three-phase electric cable structure arrangement of claim 1, the method comprising:

arranging the sub-conductors of the three sets in the intervening manner such that each sub-conductor of one of said three sets is placed adjacent and alongside at least two neighboring sub-conductors of at least another one of said three sets associated with either a different electrical phase or electric current direction; and for each set of sub-conductors, electrically connecting in parallel the sub-conductors of the set, such that when said electric cable structure arrangement is put in operation, electric current in each two neighboring sub-conductors have different phases.

13. A method according to claim 12, wherein arranging the sub-conductors includes placing sub-conductors having greater cross-sectional areas closer to a geometric cross-sectional center of the electric cable structure arrangement, and sub-conductors having smaller cross-sectional areas closer to boundaries of a cross-section of the electric cable structure arrangement.

14. A method according to claim 12, comprising arranging the sub-conductors on a circumference of a circle and adding either a grounding conductor or a neutral conductor to the electric cable structure arrangement placed at a center of the circle.

15. A method according claim 12 comprising adding a grounding conductor placed beside and alongside the sub-conductors of the electric cable structure arrangement.

16. A method according to claim 12 wherein the arranging of the sub-conductors comprises arranging the sub-conductors around a central supporting element configured and operable to hold and immobilize the sub-conductors in the electric cable structure arrangement.

17. A method according to claim 12 comprising enclosing the sub-conductors of the electric cable structure arrangement in at least one neutral conductor shaped in form of a hollow tube.

18. A method according to claim 12, wherein the arranging of the three sets of sub-conductors comprising placing them on a circumference of a circle such that an angle between neighboring sub-conductors on the circumference is 60°, and an angle between adjacently located sub-conductors carrying the same phase is 180°.

19. A method according to claim 12, wherein the three-phase cable configured from first and second sets of the sub-conductors associated with first and second phases of the three-phase electric cable structure arrangement respectively, and a conductor associated with a third phase of the three-phase electric cable structure arrangement, the arranging of the sets of sub-conductors comprising placing said first and second sets of the sub-conductors on a circumference of a circle and placing said conductor associated with said third phase of the cable phase at a center of the circle, and arranging the sub-conductors of said first and second sets of the sub-conductors such that an angle between neighboring sub-conductors on the circumference is 90°, and an angle between adjacently located conductors carrying the same phase is 180°.

20. A method according to claim 12 comprising reducing the amount of electrically conductive material of the three-phase cable by setting the cross-sectional areas of the sub-conductors of the three-phase cable to obtain the smaller total cross sectional area satisfying the electric current density required for the three-phase original cable design.

21. A method of designing a three-phase electric cable having the electric cable structure arrangement of claim 1 and the nominal maximal permitted electric current density, the method comprising:

selecting for each sub-conductor of the three sets of sub-conductors a cross-sectional areas such that a sum of the cross-sectional areas of the sub-conductors in each set is smaller than a phase conductor cross-sectional area of said conventional three-phase cable original design having the nominal maximal permitted electrical current density; and arranging magnetic dipoles from currents passing through the sub-conductors when the sub-conductors of each of the three sets being electrically connected to each other in parallel, and determining value and direction of magnetic moment of each of the magnetic dipoles and adjusting the arrangement of said sub-conductors such that a sum of the magnetic moments is substantially zeroed.

22. A method according to claim 21, wherein the arranging of the sub-conductors includes placing sub-conductors having greater cross-sectional areas near a geometric cross-sectional center of the three-phase electric cable structure arrangement, and placing sub-conductors having smaller cross-sectional area near edges of the three-phase electric cable structure arrangement cross-section.

23. A method according to claim 21, wherein the selecting of the number of sub-conductors n in each set of sub-conductors includes increasing the number of sub-conductors in the design, and reducing the cross-sectional areas of at least some of the sub-conductors in said set of sub-conductors to thereby obtain a smaller total cross-sectional area of the sub-conductors.

24. A method according to claim 21 comprising reducing inductance of the three-phase electric cable structure arrangement by setting the cross-sectional areas of the sub-conductors to obtain the smaller total cross sectional area satisfying the nominal maximal electric current density required for the three-phase original cable design.

25. A method according to claim 21 comprising increasing heat dissipation in the three-phase electric cable structure arrangement by about 10% to 25% with respect to the three-phase original cable design.

* * * * *